US007931156B2

(12) United States Patent
Hardy

(10) Patent No.: US 7,931,156 B2
(45) Date of Patent: Apr. 26, 2011

(54) PRODUCT MANAGEMENT DISPLAY SYSTEM WITH RETAINING WALL

(75) Inventor: Stephen N. Hardy, Wadsworth, OH (US)

(73) Assignee: RTC Industries, Inc., Rolling Meadows, IL (US)

( * ) Notice: Subject to any disclaimer, the term of this patent is extended or adjusted under 35 U.S.C. 154(b) by 830 days.

(21) Appl. No.: 11/687,356

(22) Filed: Mar. 16, 2007

(65) Prior Publication Data

US 2007/0175845 A1 Aug. 2, 2007

Related U.S. Application Data

(63) Continuation-in-part of application No. 11/465,936, filed on Aug. 21, 2006, which is a continuation of application No. 11/216,493, filed on Aug. 31, 2005, now Pat. No. 7,093,546, which is a continuation of application No. 10/474,490, filed on Oct. 8, 2003, now Pat. No. 6,964,235.

(51) Int. Cl.
*A47F 7/00* (2006.01)

(52) U.S. Cl. ..... 211/59.3

(58) Field of Classification Search ..... 211/59.3, 211/184, 175; 108/60, 61; 221/134, 194; 312/42, 45

See application file for complete search history.

(56) References Cited

U.S. PATENT DOCUMENTS

| | | | |
|---|---|---|---|
| 154,940 | A | 9/1874 | Adams |
| 355,511 | A | 1/1887 | Danner |
| 632,231 | A | 9/1899 | Blades |
| 808,067 | A | 12/1905 | Briggs |
| 847,863 | A | 3/1907 | Watts |
| 1,156,140 | A | 10/1915 | Hair |
| 1,703,987 | A | 3/1929 | Butler |
| 1,712,080 | A | 5/1929 | Kelly |
| 1,714,266 | A | 5/1929 | Johnson |
| 1,734,031 | A | 11/1929 | Carlson |
| 1,786,392 | A | 12/1930 | Kemp |
| 1,964,597 | A | 6/1934 | Rapellin |
| 1,971,749 | A | 8/1934 | Hamilton |
| 1,991,102 | A | 2/1935 | Kernaghan |
| 2,057,627 | A | 10/1936 | Ferris |

(Continued)

FOREIGN PATENT DOCUMENTS

| | | |
|---|---|---|
| BE | 906083 | 4/1987 |

(Continued)

OTHER PUBLICATIONS

*RTC Industries, Inc.*, v. *Fasteners for Retail, Inc., and SuperValu, Inc. d/b/a Cub Foods*, Stipulation of Dismissal, Civil Action No. 05 C 6940, Apr. 2006.

(Continued)

*Primary Examiner* — Sarah Purol
(74) *Attorney, Agent, or Firm* — Banner & Witcoff, Ltd.

(57) ABSTRACT

A merchandise display system includes a base-and-divider assembly. The base-and-divider assembly includes a base portion adapted for operative coupling to a front rail, and a divider portion for dividing displayed merchandise into rows. The divider portion protrudes from the base portion such that the divider portion separates the base portion into a first portion and a second portion. A spring-urged pusher is mounted to a pusher track for pushing merchandise toward the front of a shelf. A retaining wall curves inwardly from a front edge of the divider portion along at least a portion of the first portion.

26 Claims, 22 Drawing Sheets

U.S. PATENT DOCUMENTS

| | | | | |
|---|---|---|---|---|
| 2,079,754 | A | | 5/1937 | Waxgiser |
| 2,085,479 | A | | 6/1937 | Shaffer et al. |
| 2,110,299 | A | | 3/1938 | Hinkle |
| 2,111,496 | A | | 3/1938 | Scriba |
| 2,129,122 | A | | 9/1938 | Follett |
| 2,218,444 | A | | 10/1940 | Vineyard |
| 2,499,088 | A | | 2/1950 | Brill et al. |
| 2,516,122 | A | | 7/1950 | Hughes |
| 2,555,102 | A | | 5/1951 | Anderson |
| 2,563,570 | A | | 8/1951 | Williams |
| 2,652,154 | A | | 9/1953 | Stevens |
| 2,670,853 | A | | 3/1954 | Schneider |
| 2,678,045 | A | | 5/1954 | Erhard |
| 2,738,881 | A | | 3/1956 | Michel |
| 2,750,049 | A | | 6/1956 | Hunter |
| 2,775,365 | A | | 12/1956 | Mestman et al. |
| 2,893,596 | A | | 7/1959 | Gabrielsen |
| 2,918,295 | A | | 12/1959 | Milner |
| 2,934,212 | A | | 4/1960 | Jacobson |
| 2,948,403 | A | | 8/1960 | Vallez |
| 3,083,067 | A | | 3/1963 | Vos et al. |
| 3,103,396 | A | | 9/1963 | Portnoy |
| 3,151,576 | A | | 10/1964 | Patterson |
| 3,161,295 | A | | 12/1964 | Chesley |
| 3,166,195 | A | | 1/1965 | Taber |
| 3,285,429 | A | | 11/1966 | Propst |
| 3,308,961 | A | | 3/1967 | Chesley |
| 3,308,964 | A | | 3/1967 | Pistone |
| 3,348,732 | A | | 10/1967 | Schwartz |
| 3,405,716 | A | | 10/1968 | Cafiero et al. |
| 3,452,899 | A | | 7/1969 | Libberton |
| 3,497,081 | A | | 2/1970 | Field |
| 3,501,020 | A | | 3/1970 | Krikorian |
| D219,058 | S | | 10/1970 | Kaczur |
| 3,550,979 | A | | 12/1970 | Protzmann |
| 3,598,246 | A | | 8/1971 | Galli |
| 3,652,154 | A | | 3/1972 | Gebel |
| 3,667,826 | A | | 6/1972 | Wood et al. |
| 3,698,568 | A | | 10/1972 | Armstrong |
| 3,709,371 | A | | 1/1973 | Luck |
| 3,751,129 | A | | 8/1973 | Wright et al. |
| 3,814,490 | A | | 6/1974 | Dean et al. |
| 3,815,519 | A | | 6/1974 | Meyer |
| 3,830,169 | A | | 8/1974 | Madey |
| 3,836,008 | A | | 9/1974 | Mraz |
| 3,848,745 | A | | 11/1974 | Smith |
| 3,868,021 | A | | 2/1975 | Heinrich |
| 3,870,156 | A | | 3/1975 | O'Neill |
| 4,007,841 | A | | 2/1977 | Seipel |
| 4,042,096 | A | | 8/1977 | Smith |
| 4,106,668 | A | | 8/1978 | Gebhardt et al. |
| 4,269,326 | A | | 5/1981 | Delbrouck |
| 4,300,693 | A | | 11/1981 | Spamer |
| 4,303,162 | A | | 12/1981 | Suttles |
| 4,314,700 | A | | 2/1982 | Dylag |
| 4,331,243 | A | | 5/1982 | Doll |
| 4,351,439 | A | | 9/1982 | Taylor |
| 4,378,872 | A | | 4/1983 | Brown |
| 4,448,653 | A | | 5/1984 | Wegmann |
| 4,454,948 | A | | 6/1984 | Spamer |
| 4,460,096 | A | | 7/1984 | Ricci |
| 4,463,854 | A | | 8/1984 | MacKenzie |
| 4,467,927 | A | | 8/1984 | Nathan |
| 4,482,066 | A | | 11/1984 | Dykstra |
| 4,488,653 | A | | 12/1984 | Belokin |
| 4,504,100 | A | | 3/1985 | Chaumard |
| 4,588,093 | A | | 5/1986 | Field |
| 4,589,349 | A | | 5/1986 | Gebhardt et al. |
| 4,602,560 | A | | 7/1986 | Jacky |
| 4,615,276 | A | | 10/1986 | Garabedian |
| 4,620,489 | A | | 11/1986 | Albano |
| 4,629,072 | A | | 12/1986 | Loew |
| 4,651,883 | A | | 3/1987 | Gullett et al. |
| 4,685,574 | A | | 8/1987 | Young et al. |
| 4,705,175 | A | | 11/1987 | Howard et al. |
| 4,706,821 | A | | 11/1987 | Kohls et al. |
| 4,724,968 | A | | 2/1988 | Wombacher |
| 4,729,481 | A | | 3/1988 | Hawkinson et al. |
| 4,730,741 | A | | 3/1988 | Jackie, III et al. |
| 4,742,936 | A | | 5/1988 | Rein |
| 4,762,235 | A | | 8/1988 | Howard et al. |
| 4,762,236 | A | | 8/1988 | Jackie, III et al. |
| 4,775,058 | A | | 10/1988 | Yatsko |
| 4,776,472 | A | | 10/1988 | Rosen |
| 4,790,037 | A | | 12/1988 | Phillips |
| 4,809,856 | A | | 3/1989 | Muth |
| 4,828,144 | A | | 5/1989 | Garrick |
| 4,830,201 | A | | 5/1989 | Breslow |
| 4,836,390 | A | | 6/1989 | Polvere |
| 4,846,367 | A | | 7/1989 | Guigan et al. |
| 4,883,169 | A | | 11/1989 | Flanagan, Jr. |
| 4,899,668 | A | | 2/1990 | Valiulis |
| 4,901,853 | A | | 2/1990 | Maryatt |
| 4,901,869 | A | | 2/1990 | Hawkinson et al. |
| 4,907,707 | A | | 3/1990 | Crum |
| 4,934,645 | A | | 6/1990 | Breslow |
| 5,012,936 | A | | 5/1991 | Crum |
| 5,025,936 | A | | 6/1991 | Lamoureaux |
| 5,027,957 | A | | 7/1991 | Skalski |
| 5,082,125 | A | | 1/1992 | Ninni |
| 5,088,607 | A | | 2/1992 | Risafi et al. |
| 5,110,192 | A | | 5/1992 | Lauterbach |
| 5,111,942 | A | | 5/1992 | Bernardin |
| 5,123,546 | A | | 6/1992 | Crum |
| 5,148,927 | A | | 9/1992 | Gebka |
| 5,161,702 | A | | 11/1992 | Skalski |
| 5,178,258 | A | | 1/1993 | Smalley |
| 5,183,166 | A | | 2/1993 | Belokin, Jr. et al. |
| 5,190,186 | A | | 3/1993 | Yablans et al. |
| 5,203,463 | A | | 4/1993 | Gold |
| 5,215,199 | A | | 6/1993 | Bejarano |
| 5,255,802 | A | * | 10/1993 | Krinke et al. ..... 211/184 |
| 5,265,738 | A | | 11/1993 | Yablans et al. |
| 5,316,154 | A | | 5/1994 | Hajec, Jr. |
| 5,341,945 | A | | 8/1994 | Gibson |
| 5,351,839 | A | | 10/1994 | Beeler et al. |
| 5,366,099 | A | | 11/1994 | Schmid |
| 5,381,908 | A | | 1/1995 | Hepp |
| 5,390,802 | A | | 2/1995 | Pappagallo et al. |
| 5,413,229 | A | | 5/1995 | Zuberbuhler et al. |
| 5,415,297 | A | | 5/1995 | Klein et al. |
| 5,450,969 | A | | 9/1995 | Johnson et al. |
| 5,458,248 | A | | 10/1995 | Alain |
| 5,464,105 | A | * | 11/1995 | Mandeltort ..... 211/184 |
| 5,469,975 | A | | 11/1995 | Fajnsztajn |
| 5,469,976 | A | | 11/1995 | Burchell |
| 5,542,552 | A | | 8/1996 | Yablans et al. |
| 5,562,217 | A | | 10/1996 | Salveson et al. |
| 5,613,621 | A | | 3/1997 | Gervasi |
| D378,888 | S | | 4/1997 | Bertilsson |
| 5,615,780 | A | | 4/1997 | Nimetz et al. |
| 5,634,564 | A | | 6/1997 | Spamer et al. |
| 5,638,963 | A | | 6/1997 | Finnelly et al. |
| 5,665,304 | A | | 9/1997 | Heinen et al. |
| 5,673,801 | A | | 10/1997 | Markson |
| D386,363 | S | | 11/1997 | Dardashti |
| 5,685,664 | A | | 11/1997 | Parham et al. |
| 5,730,320 | A | | 3/1998 | David |
| 5,738,019 | A | | 4/1998 | Parker |
| 5,740,944 | A | * | 4/1998 | Crawford ..... 221/134 |
| 5,743,428 | A | | 4/1998 | Rankin, VI |
| 5,746,328 | A | | 5/1998 | Beeler et al. |
| 5,788,090 | A | | 8/1998 | Kajiwara |
| 5,803,276 | A | | 9/1998 | Vogler |
| 5,826,731 | A | | 10/1998 | Dardashti |
| 5,839,588 | A | | 11/1998 | Hawkinson |
| 5,855,283 | A | | 1/1999 | Johnson |
| 5,873,473 | A | | 2/1999 | Pater |
| 5,878,895 | A | | 3/1999 | Springs |
| 5,906,283 | A | | 5/1999 | Kump et al. |
| 5,971,204 | A | | 10/1999 | Apps |
| 6,006,678 | A | | 12/1999 | Merit |
| 6,041,720 | A | * | 3/2000 | Hardy ..... 108/60 |
| 6,082,557 | A | | 7/2000 | Leahy |
| 6,112,938 | A | * | 9/2000 | Apps ..... 221/194 |
| 6,129,218 | A | | 10/2000 | Henry et al. |
| 6,142,317 | A | * | 11/2000 | Merl ..... 211/59.3 |

| | | | | |
|---|---|---|---|---|
| 6,164,491 | A | 12/2000 | Bustos et al. | |
| 6,173,845 | B1 | 1/2001 | Higgins et al. | |
| 6,209,733 | B1 | 4/2001 | Higgins et al. | |
| 6,227,385 | B1 | 5/2001 | Mickerson | |
| 6,234,325 | B1 | 5/2001 | Higgins et al. | |
| 6,234,326 | B1 | 5/2001 | Higgins et al. | |
| 6,234,328 | B1 | 5/2001 | Mason | |
| D445,615 | S | 7/2001 | Burke | |
| 6,253,954 | B1 | 7/2001 | Yasaka | |
| 6,357,606 | B1 | 3/2002 | Henry | |
| 6,382,431 | B1 | 5/2002 | Burke | |
| 6,389,991 | B1 * | 5/2002 | Morrisson | 108/61 |
| 6,401,942 | B1 | 6/2002 | Eckert | |
| 6,405,880 | B1 | 6/2002 | Webb | |
| 6,409,027 | B1 | 6/2002 | Chang et al. | |
| 6,409,028 | B2 | 6/2002 | Nickerson | |
| 6,464,089 | B1 | 10/2002 | Rankin, VI | |
| 6,484,891 | B2 | 11/2002 | Burke | |
| 6,497,326 | B1 | 12/2002 | Osawa | |
| 6,523,703 | B1 | 2/2003 | Robertson | |
| 6,527,127 | B2 | 3/2003 | Dumontet | |
| 6,533,131 | B2 | 3/2003 | Bada | |
| D472,411 | S | 4/2003 | Burke | |
| 6,598,754 | B2 | 7/2003 | Weiler | |
| 6,622,874 | B1 | 9/2003 | Hawkinson | |
| 6,655,536 | B2 | 12/2003 | Jo et al. | |
| 6,666,533 | B1 | 12/2003 | Stavros | |
| D485,699 | S | 1/2004 | Mueller et al. | |
| 6,772,888 | B2 | 8/2004 | Burke | |
| 6,866,156 | B2 | 3/2005 | Nagel et al. | |
| 6,886,699 | B2 * | 5/2005 | Johnson et al. | 211/59.3 |
| 6,889,854 | B2 * | 5/2005 | Burke | 211/59.3 |
| 6,948,900 | B1 | 9/2005 | Neuman | |
| 6,964,235 | B2 * | 11/2005 | Hardy | 108/61 |
| 7,216,770 | B2 | 5/2007 | Mueller | |
| 7,395,938 | B2 | 7/2008 | Merit et al. | |
| 7,458,473 | B1 | 12/2008 | Mason | |
| 7,641,057 | B2 * | 1/2010 | Mueller et al. | 211/59.3 |
| 2001/0010302 | A1 | 8/2001 | Nickerson | |
| 2002/0036178 | A1 | 3/2002 | Tombu | |
| 2002/0108916 | A1 | 8/2002 | Nickerson | |
| 2002/0148794 | A1 | 10/2002 | Marihugh | |
| 2002/0170866 | A1 | 11/2002 | Johnson et al. | |
| 2003/0000956 | A1 | 1/2003 | Maldonado | |
| 2003/0010732 | A1 | 1/2003 | Burke | |
| 2003/0057167 | A1 | 3/2003 | Johnson et al. | |
| 2003/0061973 | A1 | 4/2003 | Bustos | |
| 2003/0085187 | A1 * | 5/2003 | Johnson et al. | 211/59.3 |
| 2003/0141265 | A1 | 7/2003 | Jo et al. | |
| 2003/0217980 | A1 | 11/2003 | Johnson et al. | |
| 2004/0104239 | A1 | 6/2004 | Black, Jr. et al. | |
| 2004/0140278 | A1 | 7/2004 | Mueller et al. | |
| 2004/0140279 | A1 | 7/2004 | Mueller et al. | |
| 2004/0245197 | A1 | 12/2004 | McElvaney | |
| 2006/0049122 | A1 | 3/2006 | Mueller et al. | |
| 2006/0163272 | A1 | 7/2006 | Gamble | |
| 2006/0186064 | A1 | 8/2006 | Merit et al. | |
| 2006/0237381 | A1 | 10/2006 | Lockwood et al. | |

FOREIGN PATENT DOCUMENTS

| | | | |
|---|---|---|---|
| CH | 412 251 | | 4/1966 |
| DE | 969003 | | 4/1958 |
| DE | 1819158 | | 7/1960 |
| DE | 2002720 | | 7/1971 |
| DE | 7311113 | | 8/1973 |
| DE | 2232398 | | 1/1974 |
| DE | 28 25 724 | A1 | 12/1979 |
| DE | 8308485 | | 9/1983 |
| DE | 8426651 | | 7/1985 |
| DE | 299 02 688 | | 7/1999 |
| EP | 0004921 | | 4/1979 |
| EP | 0018003 | | 7/1984 |
| EP | 0224107 | A2 | 11/1986 |
| EP | 270016 | | 6/1988 |
| EP | 0 337 340 | | 10/1989 |
| EP | 0408400 | A1 | 7/1990 |
| EP | 0 398 500 | A1 | 11/1990 |
| EP | 0408400 | A | 1/1991 |
| EP | 0 454 586 | B1 | 10/1991 |
| EP | 0587059 | | 3/1994 |
| EP | 986980 | | 3/2000 |
| EP | 0 779 047 | B1 | 4/2000 |
| EP | 1395152 | | 2/2005 |
| EP | 0176209 | | 4/2008 |
| FR | 2 385 365 | | 10/1978 |
| FR | 2526338 | | 11/1983 |
| FR | 2617385 | | 1/1989 |
| GB | 697994 | | 10/1953 |
| GB | 740311 | | 11/1955 |
| GB | 881700 | | 11/1961 |
| GB | 1082150 | | 9/1967 |
| GB | 2 027339 | A | 2/1980 |
| GB | 2037553 | | 7/1994 |
| GB | 2281289 | | 1/1995 |
| GB | 2 283 407 | A | 5/1995 |
| GB | 2290077 | | 12/1995 |
| GB | 2297241 | A | 7/1996 |
| GB | 1088654 | | 11/2000 |
| GB | 2392667 | A | 10/2004 |
| JP | 54168195 | | 11/1979 |
| JP | 59 218113 | | 8/1984 |
| JP | 62060521 | A | 3/1987 |
| JP | 6329463 | | 2/1988 |
| JP | 02-191413 | | 7/1990 |
| JP | 6202945 | | 7/1994 |
| JP | 11342054 | | 12/1999 |
| JP | 2000157378 | | 6/2000 |
| JP | 2000350642 | | 12/2000 |
| JP | 2001104117 | | 4/2001 |
| JP | 2003210286 | | 7/2003 |
| NL | 106617 | | 11/1963 |
| NL | 8520125 | | 1/1986 |
| SE | 394537 | | 6/1977 |
| SU | 1600615 | | 10/1990 |
| WO | 91/15141 | A | 10/1991 |
| WO | 00 71004 | | 11/2000 |

OTHER PUBLICATIONS

*RTC* vs. *Fasteners for Retail*, Case No. 05C 6940, Document No. 26, filed Apr. 25, 2006.

*RTC Industries, Inc.*, v. *HMG Worldwide Corporation*, Complaint, Civil Action No. 00C 3300, dated May 31, 2000.

*RTC Industries, Inc.* v. *HMG Worldwide Corporation*, Amended Complaint, dated Jan. 19, 2001.

*RTC Industries, Inc.* v. *HMG Worldwide Corporation*, RTC's Reply to HMG Worldwide Corporation's Amended Counterclaims, Civil Action No. 00 CV 3300, dated Mar. 7, 2001.

*RTC Industries, Inc.* v. *William Merit & Associates, Inc.*, Memorandum Opinion, Civil Action No. 04 C 1254, dated Jul. 15, 2004.

*RTC Industries, Inc.* v. *HMG Worldwide Corporation*, Notice of Motion, Civil Action No. 00 Civ. 3300 (JHL), dated Feb. 22, 2001.

*RTC Industries, Inc.* v. *William Merit & Associates, Inc.*, Evidentiary Objections to RTC Industries, Inc.'s Memorandum in Opposition to William Merit & Associates' Motion for Partial Summary Judgment, Civil Action No. 04 C 1254, dated Jul. 2, 2004.

*RTC Industries, Inc.*, v. *William Merit & Associates, Inc.*, William Merit & Associates' Reply to RTC Industries, Inc.'s Response to William Merit & Associates' Statement under Local Rule 56.1 of Material Facts to Which There is No Genuine Issue and Statement of Additional Facts that Require the Denial of Summary Judgment, Civil Action No. 04 C 1254, dated Jul. 2, 2004.

*RTC Industries, Inc.* v. *William Merit & Associates, Inc.*, Exhibits and Declarations in Support of William Merit & Associates, Inc.'s Reply to RTC Industries, Inc.'s Memorandum in Opposition to William Merit & Associates' Motion for Partial Summary Judgment, Civil Action No. 04 C 1254, dated Jul. 2, 2004.

*RTC Industries, Inc.*, v. *William Merit & Associates, Inc.*, Notice of RTC Industries, Inc.'s Motion for Leave to File its Sur-Reply to William Merit's Motion for Partial Summary Judgment, Civil Action No. 04 C 1254, dated Jul. 6, 2004.

*RTC Industries, Inc.*, v. *William Merit & Associates, Inc.*, RTC Industries, Inc.'s Sur-Reply to William Merit's Motion for Partial Summary Judgment, Civil Action No. 04 C 1254, dated Jul. 6, 2004.

*RTC Industries, Inc.* v. *William Merit & Associates, Inc.* RTC's Response to Defendant's Evidentiary Objections to RTC Industries, Inc.'s Memorandum in Opposition to William Merit & Associates' Motion for Partial Summary Judgment, Civil Action No. 04 C 1254, dated Jul. 6, 2004.
*RTC Industries, Inc.* v. *Fasteners for Retail Inc.*, Plaintiff RTC Industries Inc.'s Complaint, Civil Action No. 03C 3137, dated May 12, 2003.
*RTC Industries, Inc.*, v. *Fasteners for Retail Inc., and CVS Corporation*, Amended Complaint, Civil Action No. 03C 3137, dated Aug. 6, 2003.
*RTC Industries, Inc.* v. *Semasys, Inc., and Uni-Sun, Inc.*, Complaint, Civil Action No. 04C 4081, dated Jun. 17, 2004.
*RTC Industries, Inc.* v. *Display Specialties, Inc.*, Complaint, Civil Action No. 04C 3370, dated May 12, 2004.
*RTC Industries, Inc.* v. *William Merit & Associates, Inc.*, Complaint, Civil Action No. 04C 1254, dated Feb. 18, 2004.
*RTC Industries, Inc.* v. *William Merit & Associates, Inc.*, Defendants Notice of Motion for Partial Summary Judgment of Non-Infringement that Claims 1-8 of U.S. Patent No. 4,830,201 are Not Infringed, Civil Action No. 040 1254, dated Apr. 29, 2004.
*RTC Industries, Inc.*, v. *William Merit & Associates*, *William Merit & Associates*, Inc.'s Statement Under Local Rule 56.1 of Material Facts to Which There is no Genuine Issue, Civil Action No. 04 C 1254, dated Apr. 29, 2004.
*RTC Industries, Inc.* v. *William Merit & Associates, Inc.*, Defendant's Notice of Motion for Leave to File Memorandum in Support of Motion for Partial Summary Judgment in Excess of Page Limit, Civil Action No. 04 C 1254, dated Apr. 29, 2004.
*RTC Industries, Inc.* v. *William Merit & Associates, Inc.*, Declaration of William Merit in Support of Defendant's Motion for Partial Summary Judgment that Claims 1-8 of U.S. Patent No. 4,830,201 are Not Infringed, Civil Action No. 04 C 1254, dated Apr. 29, 2004.
*RTC Industries, Inc.* v. *William Merit & Associates, Inc.*, RTC Industries, Inc.'s Responses to Defendant William Merit & Associates, Inc.'s First Set of Requests for Admission to Plaintiff RTC Industries, Inc., Civil Action No. 04 C 1254, dated Jun. 1, 2004.
*RTC Industries, Inc.*, v. *William Merit & Associates, Inc.*, RTC Industries, Inc.'s Memorandum in Opposition to William Merit & Associates' Motion for Partial Summary Judgment, Civil Action No. 04 C 1254, dated Jun. 18, 2004.
*RTC Industries, Inc.* v. *William Merit & Associates, Inc.*, Notice of Filing of Additional Exhibit (The Chesley Patent) to RTC Industries, Inc.'s Memorandum in Opposition to William Merit & Associates' Motion for Partial Summary Judgment, Civil Action No. 04 C 1254, dated Jun. 22, 2004.
*RTC Industries, Inc.* v. *William Merit & Associates, Inc.*, William Merit & Associates Inc.'s Reply to RTC Industries, Inc.'s Memorandum in Opposition to William Merit & Associates' Motion for Partial Summary Judgment, dated Jul. 2, 2004.
*RTC Industries, Inc.*, v. *Fasteners for Retail, Inc. And SuperValu, Inc. d/b/a Cub Foods*, Answer of Defendant Fasteners for Retail, Inc., Civil Action No. 05 C 6940, Document 20, filed Jan. 18, 2006.
*RTC Ind* v. *William Merit& Assoc.*, United States District Court Northern District of Illinois (Chicago), Case #:1:04- cv-01254.
*RTC Ind.* v. *Fasteners For Retail, et al.*, United States District Court Northern District of Illinois (Chicago), Case #:1:03-cv-03137.
*RTC Ind.* v. *HMG Worldwide Corp.*, United States District Court Northern District of Illinois (Chicago), Case #:1:00-cv-03300.
*RTC Ind.* v. *Display Specialties*, United States District Court Northern District of Illinois (Chicago), Case #:1:04-cv-03370.
*RTC Ind.* v. *Semasys Inc., et al.* United States District Court Northern District of Illinois (Chicago), Case #:1:04-cv-04081.
*RTC Ind.* v. *Fasteners for Retail, et al.*, United States District Court Northern District of Illinois (Chicago), Case #:1:05- v-06940.
*Vidpro International Inc.* v. *RTC Industries, Inc.*, U.S. District Court Northern District of Texas (Dallas), Case #:3:95-cv-01055-G.
*RTC Industries, Inc.* v. *Fasteners for Retail Inc.*, and CVS Corporation, Reply, Civil Action No. 03C 3137, dated Sep. 17, 2003.
*RTC Industries, Inc.* v. *Fasteners for Retail, Inc.* and CVS Pharmacy, Inc., to Vulcan Spring & Mfg. Co., Subpoena in a Civil Case, Case No. 03C 3137 N.D. Illinois, dated Oct. 28, 2003.
*RTC Industries, Inc.* v. *Fasteners for Retail Inc.*, and CVS Pharmacy, Inc., to Rexam Beauty and Closures, Inc., Subpoena in a Civil Case, Case No. 03C 3137 N.D. Illinois, dated Nov. 11, 2003.
*RTC Industries, Inc.* v. *Fasteners for Retail Inc.*, and CVS Pharmacy, Inc., to Rexam Cosmetic Packaging, Inc., Subpoena in a Civil Case, Case No. 03C 3137 N.D. Illinois, dated Nov. 11, 2003.
*RTC Industries, Inc.* v. *Fasteners for Retail Inc.*, and CVS Pharmacy, Inc., to Rexam Cosmetic Packaging, Inc., Subpoena in a Civil Case No. 03C 3137 N.D. Illinois, dated Nov. 11, 2003.
*RTC Industries, Inc.* v. *Fasteners for Retail Inc.*, and CVS Pharmacy, Inc., to Rexam Beauty and Closures, Inc., Subpoena in a Civil Case, Case No. 03C 3137 N.D. Illinois, dated Nov. 11, 2003.
*RTC Industries, Inc.* v. Fasteners for Retail Inc., and CVS Corporation, Notice of Motion to Modify and Temporarily Quash Five Subpoenas for Violation of Federal Rule of Civil Procedure 45, Civil Action No. 03C 3137, dated Dec. 8, 2003.
*RTC Industries, Inc.* v. *Fasteners for Retail, Inc.* and CVS Pharmacy, Inc., Defendants' Opposition to Plaintiff's Motion to Modify and Temporarily Quash Five Subpoenas for Violation of Federal Rule of Civil Procedure 45, Case No. 03C 3137, dated Dec. 10, 2003.
*RTC Industries, Inc.* v. *Fasteners for Retail Inc.*, and CVS Corporation, RTC Industries' Reply to Defendants' Opposition to RTC's Motion to Modify and Temporarily Quash Five Subpoenas for Violation of Federal Rule of Civil Procedure 45, Civil Action No. 03C 3137, dated Dec. 11, 2003.
*RTC Ind. Inc.* v. *Fasteners for Retail*, Minute Order of Dec. 12, 2003 by Honorable Joan B. Gottschall, Case No. 1:03-cv-03137.
*RTC Industries, Inc.*, v. *William Merit & Associates, Inc.*, RTC Industries, Inc.'s Response to William Merit & Associates Statement under Local Rule 56.1 of Material Facts to Which There is No Genuine Issue and Statement of Additional Facts that Require the Denial of Summary Judgment, Civil Action No. 04 C 1254, dated Jun. 18, 2004.
*RTC Industries, Inc.*, v. *William Merit & Associates, Inc.*, Index of Exhibits, Civil Action No. 04 C 1254, dated Jun. 18, 2004.
International Search Report in corresponding PCT Serial No. PCT/US2008/056928 issued Jan. 27, 2009.
FFr Yellow Pages® 2003 Product Catalog, "Merchandising Ideas Made Easy for Every Retail Environment!", Cover p. 9-11, 48-49, 52-58, Back Cover.
*RTC Industries, Inc.*, v. *Fasteners for Retail, Inc., and SuperValu, Inc. d/b/a Cub Foods*, Complaint, Document 1, Case No. 05C 6940 filed Dec. 8, 2005.
*RTC Industries, Inc.*, v. *Fasteners for Retail, Inc., and SuperValu, Inc. d/b/a Cub Foods*, Answer of Defendant Fasteners for Retail, Inc., Civil Action No. 05 C 6940, Document 20, filed Jan. 18, 2006.
*RTC Industries, Inc.*, v. *Henschel-Steinau, Inc.*, Complaint, Case: 1:10-cv-07460 Document #:1 Filed Nov. 19, 2010.

* cited by examiner

PRODUCT MANAGEMENT DISPLAY SYSTEM WITH RETAINING WALL

This application is a continuation-in-part application of U.S. application Ser. No. 11/465,936, filed Aug. 21, 2006, which is a continuation application of U.S. application Ser. No. 11/216,493, filed Aug. 31, 2005, now U.S. Pat. No. 7,093,546, which is a continuation of U.S. application Ser. No. 10/474,490 filed Oct. 8, 2003, now U.S. Pat. No. 6,964,235, which is a continuation of PCT Application Ser. No. PCT/US02/15760, filed May 17, 2002, which claims priority to U.S. Provisional Application Ser. No. 60/291,732, filed May 17, 2001.

FIELD OF THE INVENTION

The invention relates to a system for displaying, pushing, and dividing merchandise on merchandise-display shelves.

BACKGROUND OF THE INVENTION

It is desirable to have merchandise on a shelf situated toward the front of the shelf so that the merchandise is visible and accessible to shoppers. Thus, as merchandise is removed from a shelf, it may be advantageous to push the remaining merchandise toward the front of the shelf. It may also be desirable to include dividing panels, also referred to as dividers, to separate merchandise into rows on a display shelf.

Commonly assigned U.S. Pat. No. 6,041,720 ("the '720 patent") discloses a product management display system that may be used for dividing and pushing displayed merchandise.

DE 299-02,688 U1 discloses a merchandise display system in which a base-and-divider assembly is constructed as two separate units that need to be connected to each other before being used. When this system is used with products having different sizes, product slider guides, also referred to herein as pusher tracks, of various widths need to be used to accommodate the different sizes of the products.

U.S. Pat. No. 5,265,738 discloses a merchandise display system with a pusher track that has an integrated divider wall on one side of the pusher track. Like the system disclosed by DE 299-02,688 U1, pusher tracks having different widths must be used to accommodate products of different sizes.

Referring to FIG. 1 of the '720 patent, various components, such as pusher end device 150, pusher divider 152, and pusher 154 mounted on bases 166, 212, and 232, respectively, are disclosed for mounting onto either shelf frame 25 or standard dealer shelf 40. The pusher end device 150, the pusher divider 152, and the pusher 154, which are mounted to bases 166, 212, and 232, of FIG. 1 of the '720 patent were designed with ultimate flexibility in mind. This flexibility allows these components to be assembled and used in many different ways depending on the particular product to be displayed. This presents store personnel with potentially confusing choices, which may lead to frustration, wasted time, and incorrectly installed parts. Three pusher components, namely, a full-width track, which can accept the pushing device, a divider, and a narrow track, are typically used together more often than other combinations of components. Therefore, a component that combines these devices into a single integrated assembly would be desirable.

SUMMARY

In accordance with a first aspect, a merchandise display system includes a base-and-divider assembly having a base portion adapted for operative coupling to a front rail, a divider portion for dividing displayed merchandise into rows, and a pusher track. The divider portion protrudes from the base portion such that the divider portion separates the base portion into a first portion and a second portion. A spring-urged pusher is mounted to a pusher track for pushing merchandise toward the front of a shelf. A retaining wall curves inwardly from a front edge of the divider portion along at least a portion of the first portion.

In accordance with another aspect, a merchandise display system includes a base-and-divider assembly having a base portion adapted for operative coupling to a front rail, a divider portion for dividing displayed merchandise into rows, and a pusher track. The divider portion protrudes from the base portion such that the divider portion separates the base portion into a first portion and a second portion. A spring-urged pusher is mounted to the pusher track for pushing merchandise toward the front of a shelf. A transparent retaining wall curves inwardly from a front edge of the divider portion along an arc of about 90° along the first portion.

In accordance with a further aspect, a merchandise display system includes a plurality of base-and-divider assemblies. Each base-and-divider assembly includes a base portion, a divider portion for dividing displayed merchandise into rows and a pusher track. The divider portion protrudes from the base portion such that the divider portion separates the base portion into a first portion and a second portion. A plurality of ribs is formed on a lower surface of each base portion. Each of a plurality of spring-urged pushers is configured to be mounted to a pusher track for pushing merchandise toward the front of a shelf. A front of each base portion is configured to be mounted to a front rail. A secondary rail has a plurality of projections, with the projections being configured to mesh with the ribs.

An integrated "T" assembly, also referred to as a base-and-divider assembly, in accordance with an illustrative embodiment of the invention combines into a single integrated assembly, a full-width track, a divider, and a narrow track. A narrow and strong end-finisher piece may be used to provide a second divider-like partition and, optionally a wide or narrow track, for pairing with a T assembly's narrow-track or wide-track portion near an end of either side of a shelf.

In accordance with an illustrative embodiment of the invention, a spring-urged offset pusher may have an upper portion that is offset, via an angled offset portion, from a lower portion of the pusher. The upper offset portion may advantageously extend farther out toward the center of various products to be displayed. Such an offset pusher may allow for using a minimal number of components while still pushing products relatively near to their centers, having the advantage of pushing them smoothly with less binding. When displaying a wide product, one or more supporting tracks, any of which may have a pusher, may be used under the product.

In accordance with an illustrative embodiment of the invention, a T assembly and/or a full track may be coupled to a front rail via a complimentary tongue and groove arrangement. Any of the components having a divider panel, such as a T assembly, an end finisher, and a full-width track, may also contain any of various engagement mechanisms for non-slidably engaging with a front rail's corresponding engagement mechanism. For instance, teeth on a base may engage corresponding teeth on the front rail. Teeth of this type advantageously allow a T assembly, full-width track, and/or end finishers with corresponding teeth to be located at positions virtually continuously along the front rail and may prevent the components from being moved unintentionally from their intended positions during normal shopping activity and shelf re-stocking.

In accordance with an illustrative embodiment of the invention, a T assembly may include a tear-off line and a break-off line. Such a tear-off line and break-off line combination may be used to advantage to produce one part that may be used for shelves having different depths, such as either 16 inches or 10 inches.

In accordance with an illustrative embodiment of the invention, a pusher track may include a depression, which may be used while re-stocking merchandise to hold a pusher near the back of a full-width track or T assembly. To use the depression to hold a pusher at the back of the track, a person may move the pusher back to the depression and may tilt the top of the pusher toward the front of the track. Merchandise may be re-stocked without having to manually hold the pusher out of the way. To remove the pusher from the depression, the pusher may be pushed toward the back of the track, the pusher will then return to an upright position and move along the track in its usual way.

In accordance with an illustrative embodiment of the invention, front edges of the respective surfaces that the pusher travels along may automatically engage a bent portion of the pusher's coiled spring when the pusher is inserted onto the front of the track.

Additional features and advantages of the invention will be apparent upon reviewing the following detailed description.

Figure 1:
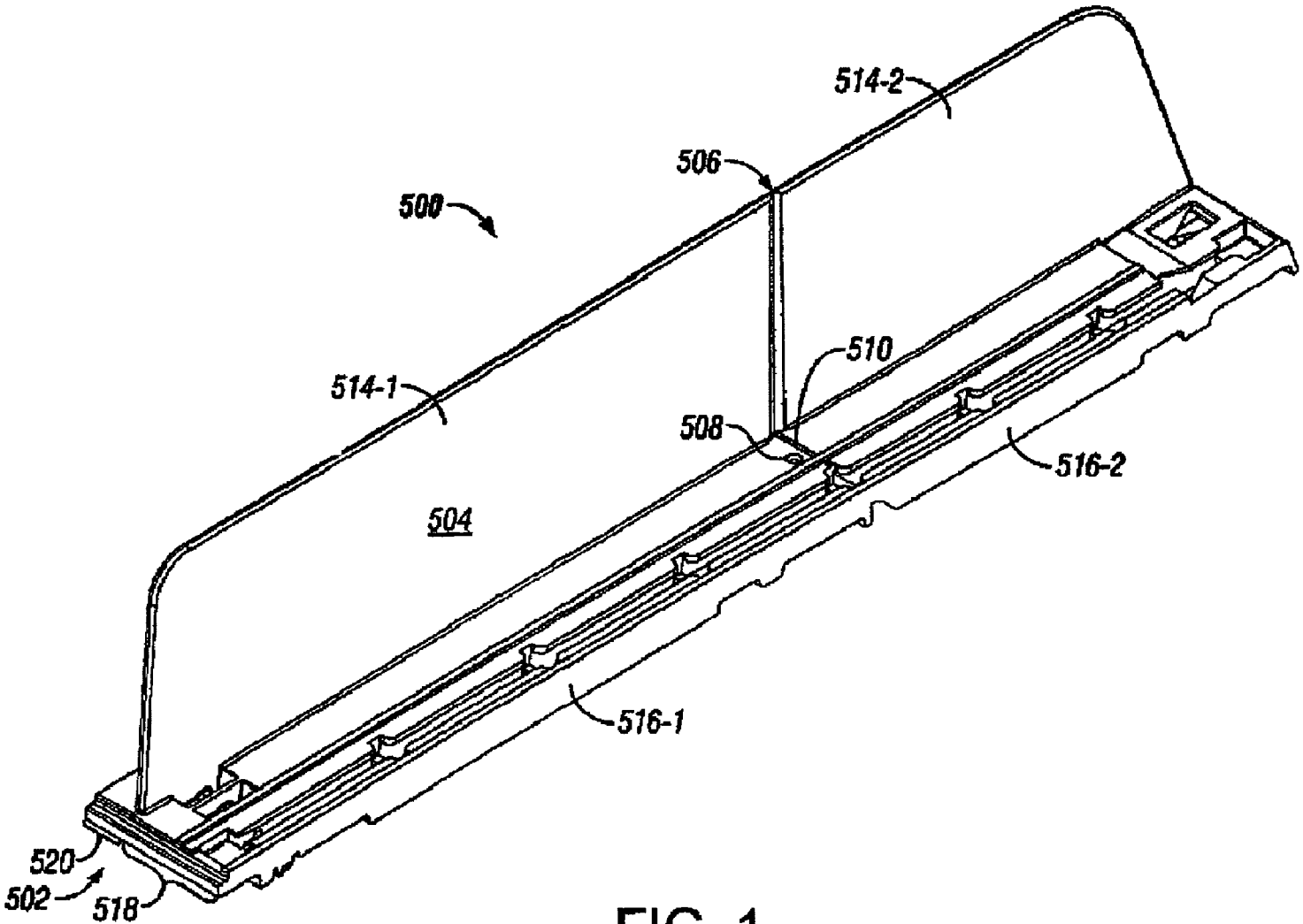
FIG. 1 depicts an integrated "T" assembly, also referred to as a base-and-divider assembly, in accordance with an illustrative embodiment of the invention.

The figures referred to above are not drawn necessarily to scale and should be understood to provide a representation of the invention, illustrative of the principles involved. Some features of the product management display system depicted in the drawings have been enlarged or distorted relative to others to facilitate explanation and understanding. The same reference numbers are used in the drawings for similar or identical components and features shown in various alternative embodiments. Product management display systems as disclosed herein would have configurations and components determined, in part, by the intended application and environment in which they are used.

DETAILED DESCRIPTION OF CERTAIN PREFERRED EMBODIMENTS

Figure 5:
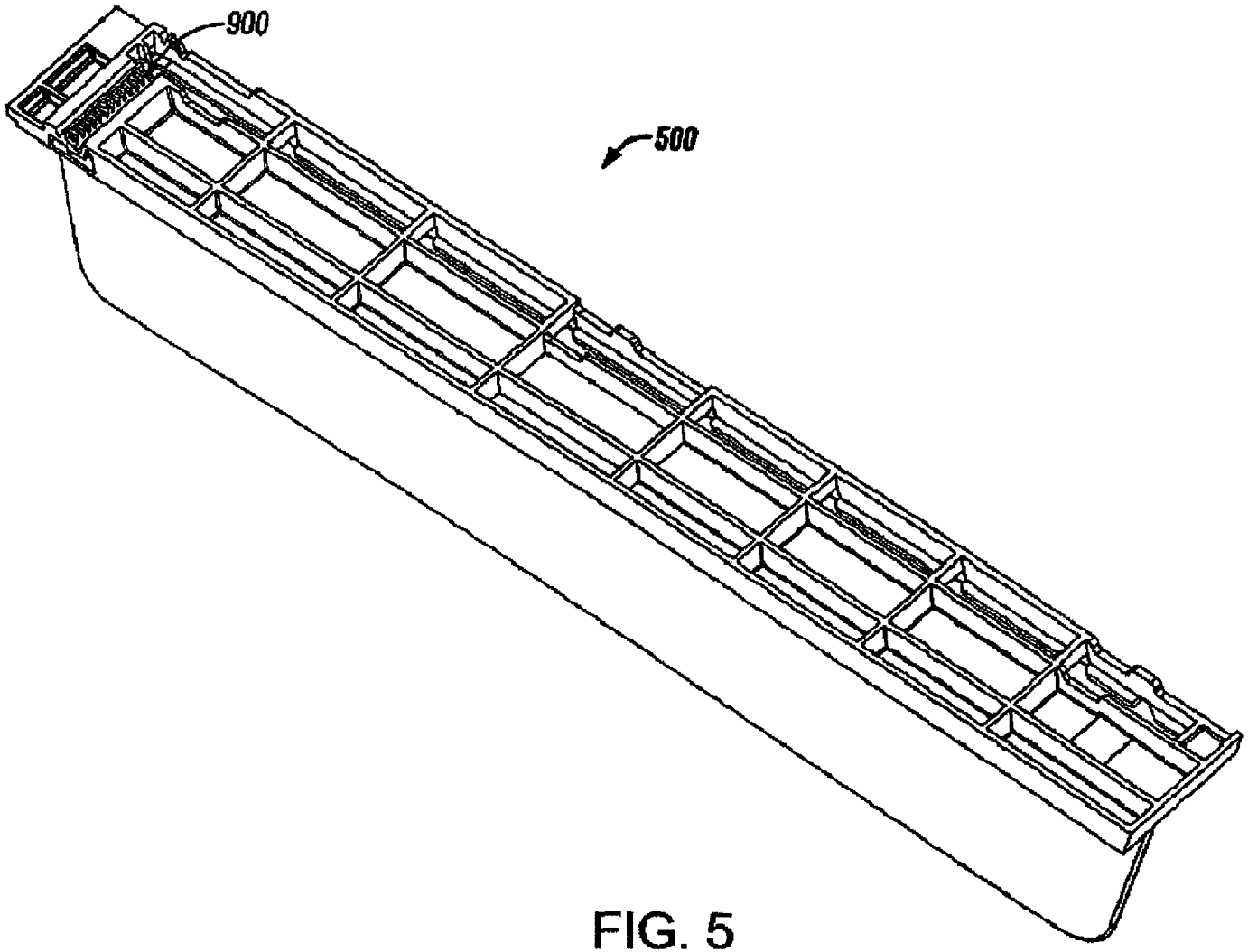
FIG. 5 is perspective view of the bottom of a T assembly in accordance with an illustrative embodiment of the invention.

FIG. 1 depicts an integrated "T" assembly 500 in accordance with an illustrative embodiment of the invention. The "T" refers to the appearance of the T assembly 500 as viewed in the direction of arrow 502 in FIG. 5. T assembly 500 would actually look like an upside-down (and off-center) T, but for the sake of brevity, it is referred to simply as a T assembly. The T assembly may also be referred to as a base-and-divider assembly. The T assembly essentially combines into a single assembly, a first track, a divider, and a second track. In accordance with an illustrative embodiment of the invention, the divider portion 504, the first portion 518 of the base, and the second portion 520 of the base may be manufactured as a single integrated component.

In accordance with an illustrative embodiment of the invention shown in FIG. 1, a divider 504 may divide the base of the T assembly 500 into a first portion 518 and a second portion 520. The first portion 518 of the base may be referred to as a wide portion of the base and the second portion 520 may be referred to as a narrow portion 520 of the base 500. As will be apparent any suitable ratio of widths may be chosen for the first and second portions of the base. For instance, the divider 504 may bisect the base such that the base's first and second portions are of a substantially equal width.

T assembly 500 may have a relatively thick and rigid divider 504 to prevent deflection that might occur when pushing round or triangular objects. Deflection of this type could cause those objects to slip by one another or not to push well in general. In FIG. 1, rigid divider 504 includes two parts, 514-1 and 514-2, which are described below.

Figure 2:
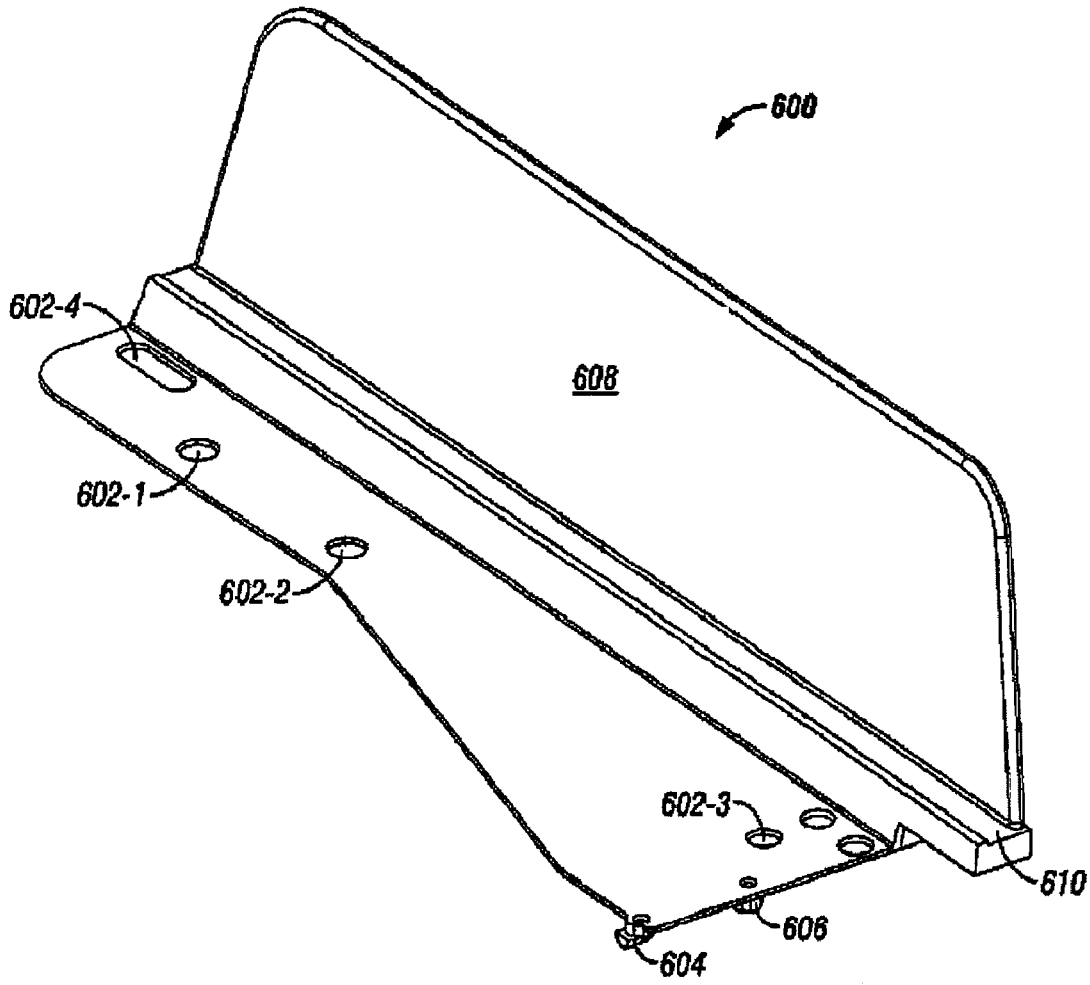
FIG. 2 depicts a right end component in accordance with an illustrative embodiment of the invention.

At either end of a shelf using the pusher components, a narrow and strong end-finisher component is desirable. Referring to FIG. 2, a right-end component 600 may be fastened to a shelf near the right-hand side of the shelf. The right-end component's divider 608 may act as the right-most divider on the shelf. The right-end component 600 may be operatively coupled to a shelf by inserting pegs 604 and 606 through corresponding holes in a shelf. One or more fasteners, such as plastic push-rivets, may be used through holes 602-1 through 602-4, and corresponding holes in a shelf, to securely fasten the right-end component to the shelf.

Figure 11:
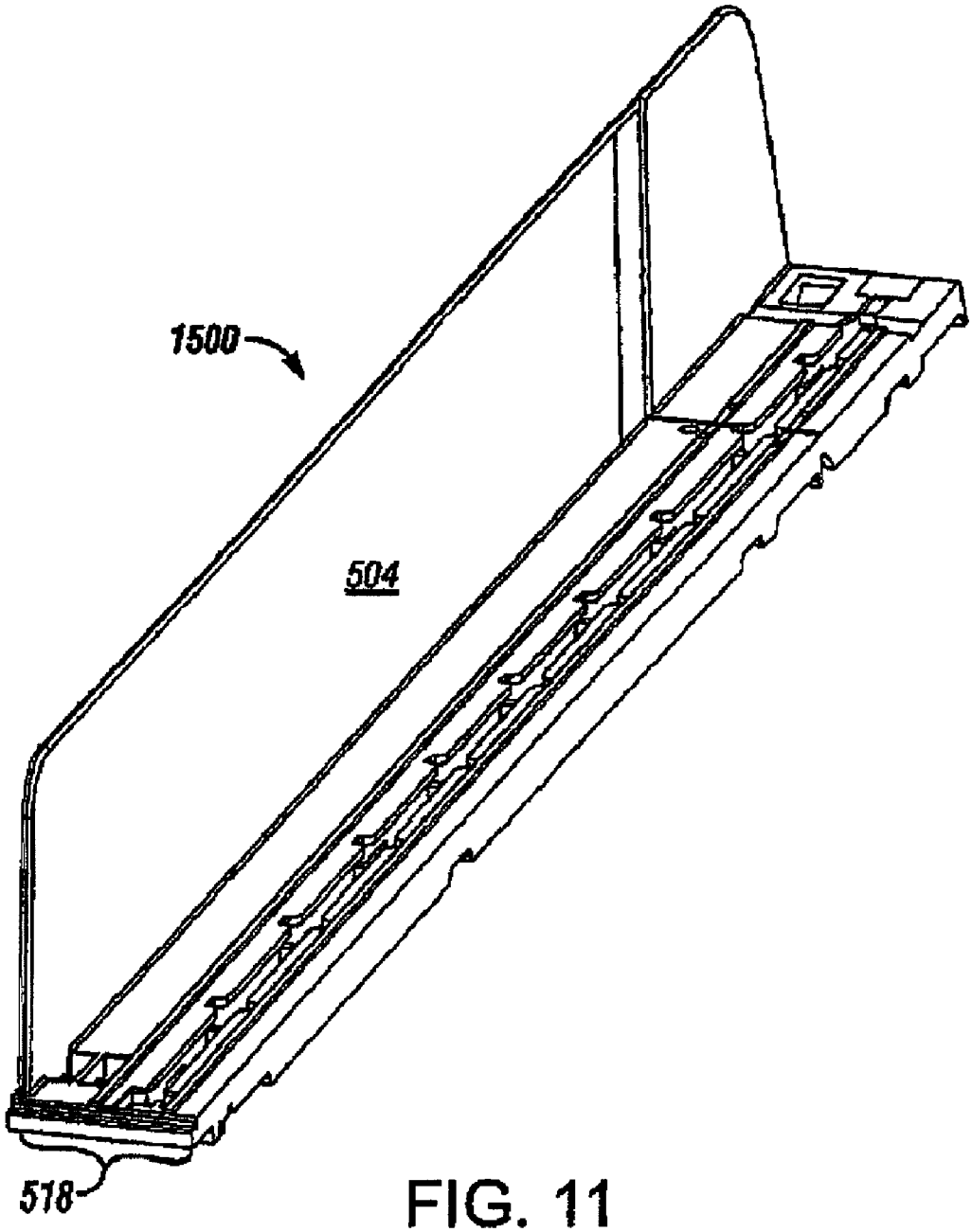
FIG. 11 depicts an integrated end component in accordance with an illustrative embodiment of the invention.

The right-end component shown in FIG. 2 is intended to be placed at a fixed location near the right side of a shelf's top surface. Referring to FIG. 11, a left-end component 1500 may be similar to a T assembly 500 except that, for the left-end component 1500 the portion of the T assembly's base to the left of the divider is omitted. Accordingly, the left-end component 15 may include a divider 504 and a base portion 518. Because the right-end component is intended to have a fixed location and the other components may have adjustable positions along a rail near the front of a shelf, components may be placed onto the shelf and the front rail from right to left to allow for maximum flexibility in adjusting the distances between the components.

Figure 3:
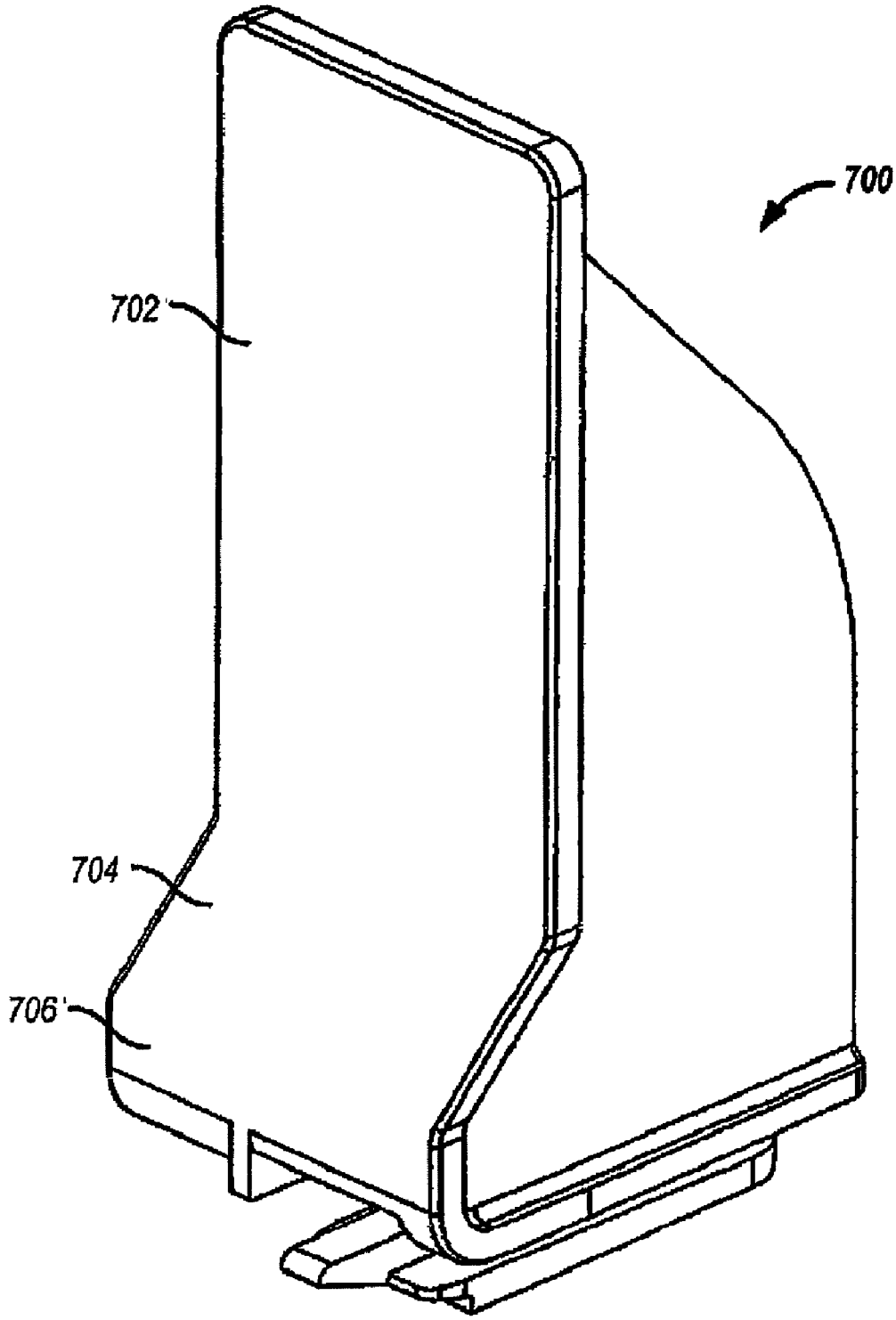
FIG. 3 shows an offset pusher in accordance with an illustrative embodiment of the invention.
Figure 10:
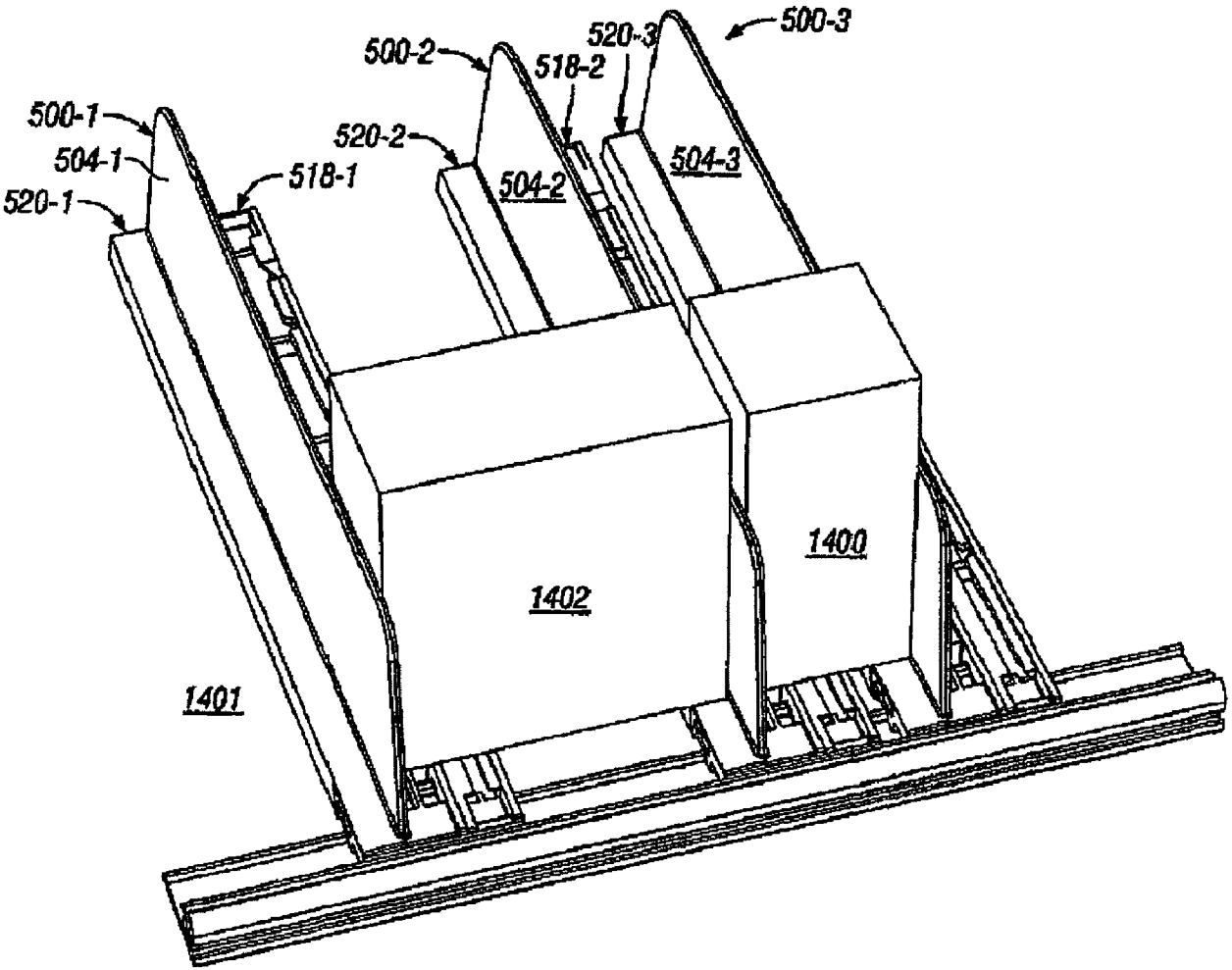
FIG. 10 depicts products of different sizes on multiple T assemblies.

The width of many products, such as deodorants, analgesics, and antihistamines, would allow a minimum number of pusher and base components to be used, spaced laterally apart from each other along a shelf, but the pushers may undesirably end up sufficiently off-center such that the products do not get pushed well. For instance, referring to FIG. 10, multiple T assemblies 500-1 through 500-3 are shown operatively coupled to a shelf 1401 via a front rail. A relatively narrow product 1400 is shown being supported by the wide portion 518-2 of the base of T assembly 500-2 and by the narrow portion 520-3 of the T assembly 500-3. T assemblies 500-2 and 500-3 are positioned relatively close to each other because product 1400 is relatively narrow. Product 1402, however, is relatively wide. T assembly 500-1, therefore, is spaced relatively far away from T assembly 500-2. The product 1402 is supported by the narrow portion 520-2 of the base of the T assembly 500-2 and the wide portion 518-1 of the base of the T assembly 500-1. Because the pusher track and pusher of the T assembly 500-1 are located relatively close to the divider 504-1 of T assembly 500-1, an offset pusher, such as the offset pusher 700 (FIG. 3) may be used so that the offset portion 702 may be positioned closer to the center of a relatively wide product, such as product 1402. Offset pusher 700 has an upper portion 702 that is offset, via an offset portion 704, from a lower portion 706 of the pusher 700. Upper offset portion 702 advantageously extends farther out toward the center of various products to be displayed. The offset pusher allows for using a minimal number of components while still pushing products relatively near to their centers.

Occasionally a product is too wide to use only T assemblies 500 on either side of the product. Under these circumstances, one or more supporting tracks may be used under the product. In addition, a product may be unusually dense and/or heavy such that the product requires another track with an additional pusher to move the product. Under these circumstances, a full-width track, such as full-width track 800, shown in FIG. 4 and also referred to as a base, may be used either with or without a pusher 700.

Figure 8:
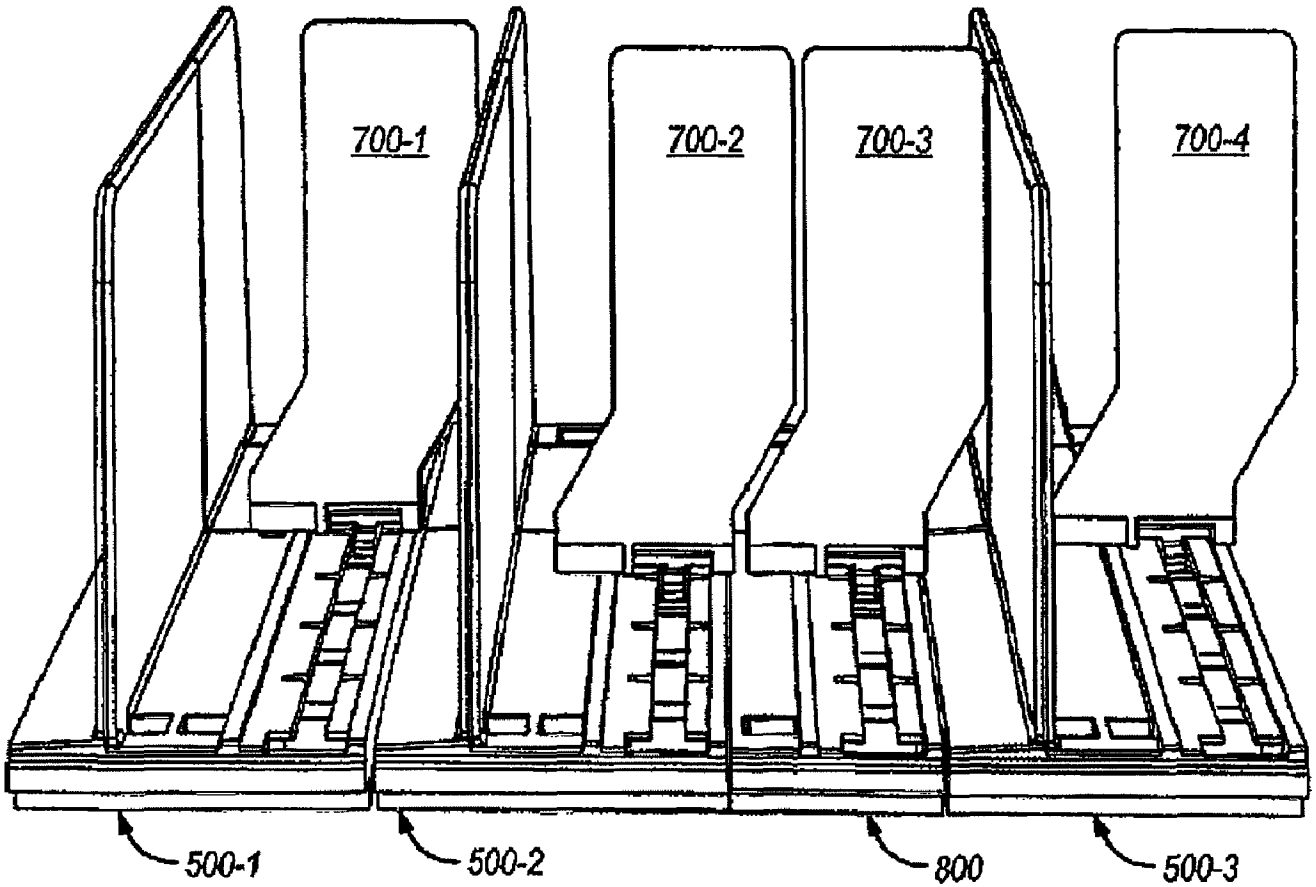
FIG. 8 depicts a full-width track with a pusher between two T assemblies in accordance with an illustrative embodiment of the invention.

For instance, FIG. 8 depicts a full-width track 800 with a pusher 700-3 between two T assemblies 500-2 and 500-3 with pushers 700-2 and 700-4 to the left and right sides, respectively, of the full-width track 800.

Figure 6:
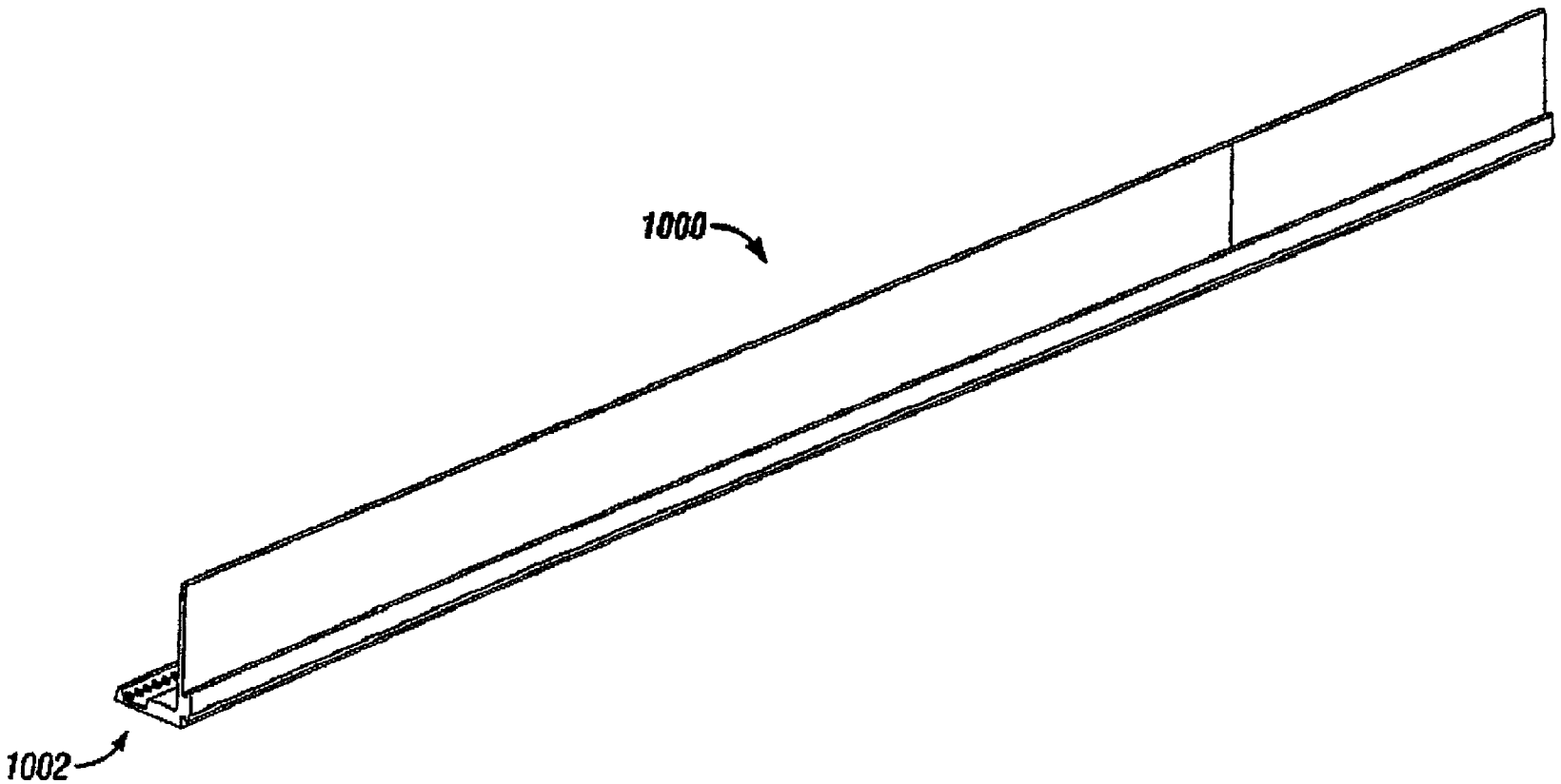
FIG. 6 is a perspective view of a front rail in accordance with an illustrative embodiment of the invention.
Figure 7:
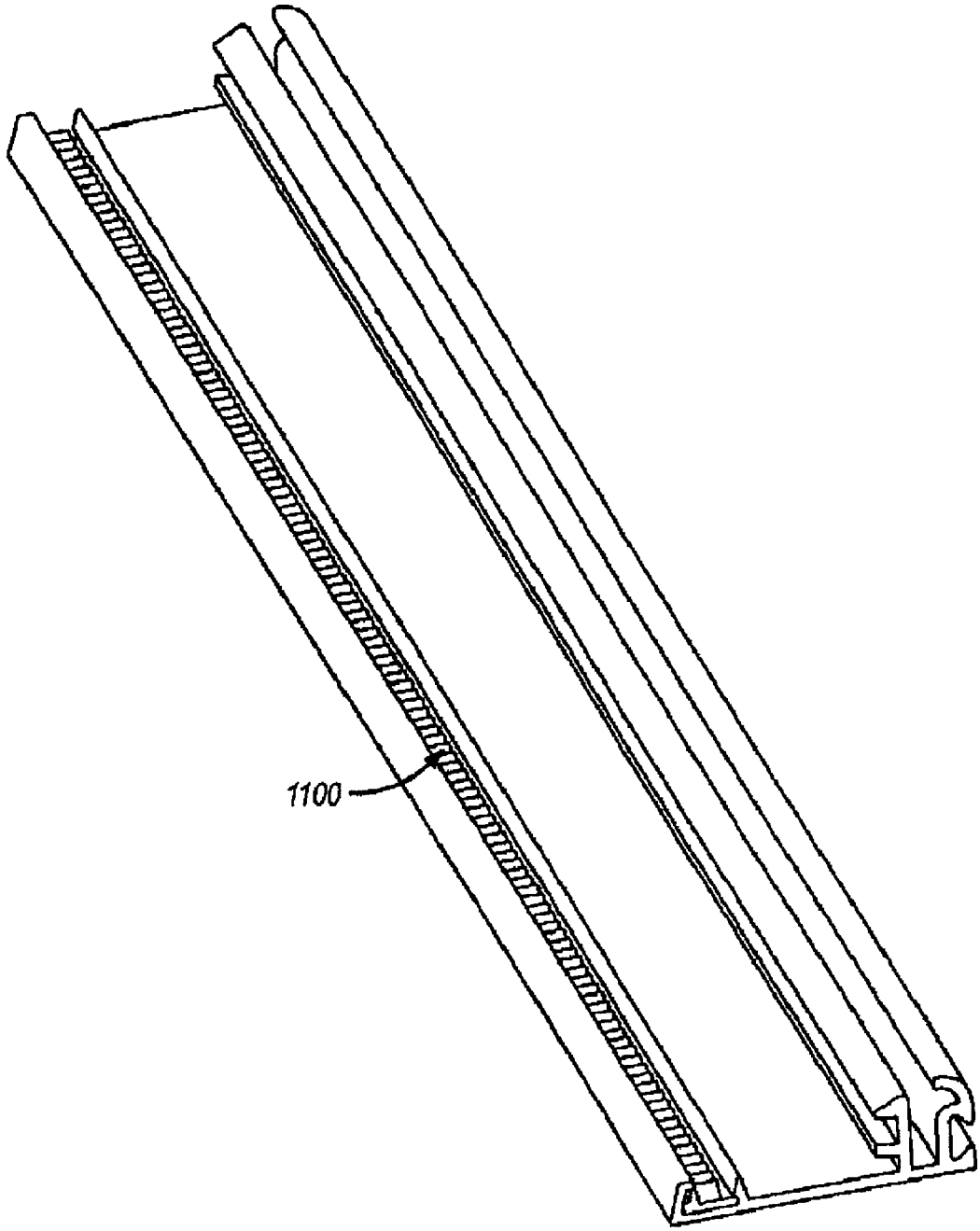
FIG. 7 is an enlarged oblique side view of the front rail of FIG. 7 in accordance with an illustrative embodiment of the invention.

In accordance with an illustrative embodiment of the invention, any of the components, which have a divider and/or a pusher track, may be coupled to a front rail via a complimentary tongue and groove arrangement as disclosed in the '720 patent. The T assembly 500 and full track 800 may non-slidably engage each other. For instance, teeth 900, shown in FIG. 5, may engage a corresponding non-slidable engagement detail in a front rail, such as front rail 1000 shown in FIG. 6. FIG. 7 is an enlarged oblique side view of the front rail 1000, viewed from the direction indicated by arrow 1002 in FIG. 6. Teeth 1100 allow a T assembly 500, full-width track 800, and/or a left-end component with corresponding teeth to be located at virtually continuous positions along the front rail. The mating teeth may be relatively thin and closely spaced to allow for precise placement of pusher-track components. The teeth advantageously prevent the components from being unintentionally moved from their intended positions during normal shopping activity and shelf re-stocking.

As will be apparent, other ways of positively engaging T assembly 500, full-width track 800, and/or a left-end component with the front rail may also be used. For instance, serrations on the front rail could bite into the bottom of the pusher-track components. A compression fit arrangement could be used in which a tongue of the pusher-track component snaps into the front rail. The front rail could have rubber in a groove that would receive a serrated tongue of a pusher-track component.

Referring again to FIG. 1, the T assembly 500 may optionally include a tear-off line, such as tear-off line 506, and a break-off line, such as break-off line 510. Such a tear-off line and break-off line combination may be used to advantage to produce one part that may be used for shelves having different depths, such as either 16 inches or 10 inches. Tear-off line 506 allows tearing of the vertically oriented divider pieces 514-1 and 514-2 as a first operation. This tearing operation may then be followed by a breaking operation to separate track piece 516-1 from track piece 516-2. The combination of the tear-off line and the break-off line facilitates removal of the rear portion of the T assembly 500. As will be apparent, a full-width track and/or a right-end finisher may also optionally include a break-off line analogous to the break-off line 510.

Figure 9:
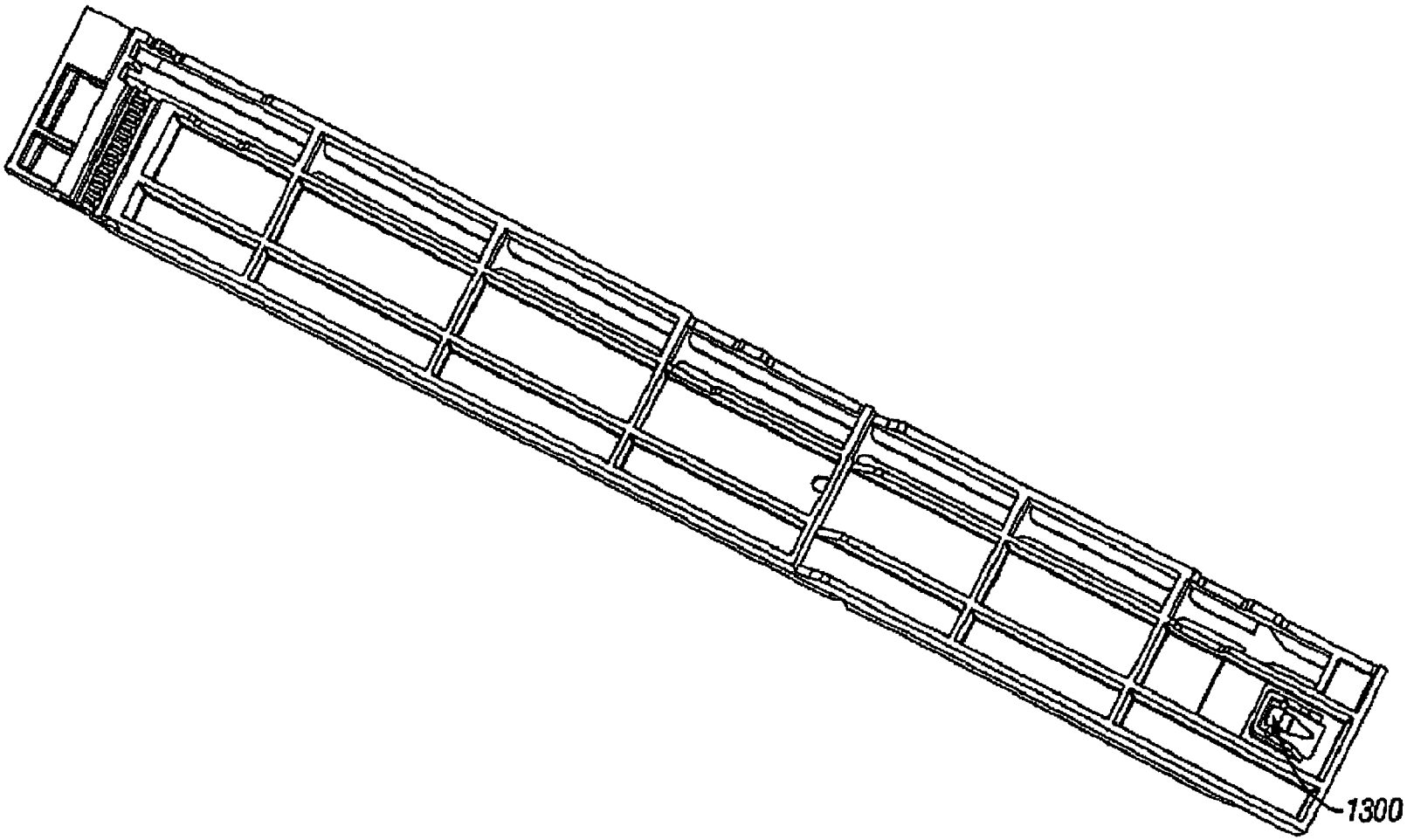
FIG. 9 is an enlarged view of the rear portion of the bottom of a T assembly in accordance with an illustrative embodiment of the invention.

After removing the rear portion of the T assembly 500 or any other base that may accept a pusher 700, the pusher 700 may be prevented from sliding out of the back of the pusher track by inserting a pin into hole 508. An exemplary pin 1300 is shown molded into the bottom rear portion of a base in FIG. 9.

Figure 4:
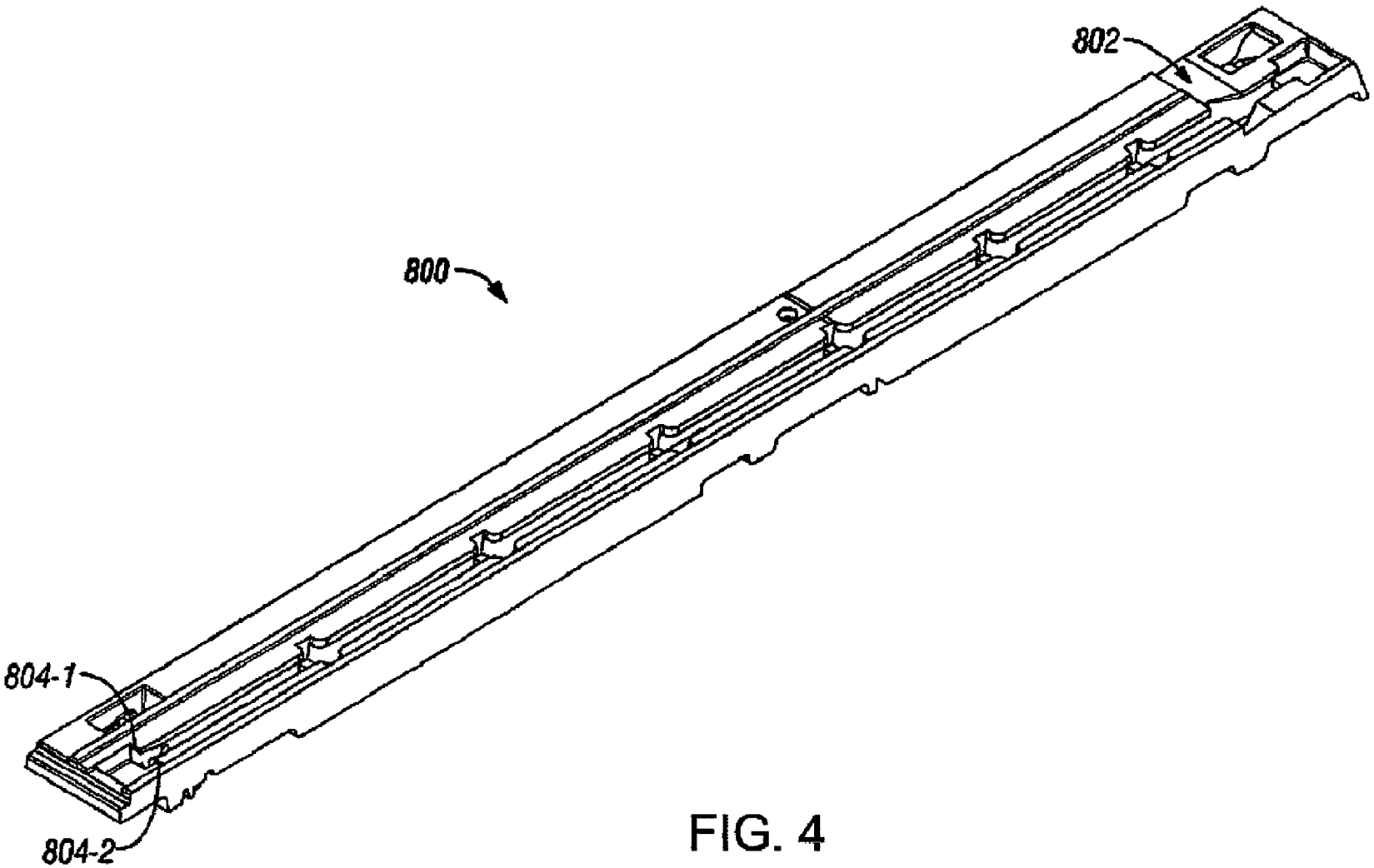
FIG. 4 shows a full-width track, also referred to as a base, which may be used with or without a pusher, in accordance with an illustrative embodiment of the invention.

Referring to FIG. 4, a depression 802 is shown. The depression 802 may be used, while re-stocking merchandise, to hold a pusher 700 near the back of a track 800 or a T assembly 500. To use the depression 802 to hold a pusher 700 at the back of the track 800, a person may move the pusher 700 back to the depression 802 and may tilt the top of the pusher 700 toward the front of the track 800, for instance, in a direction opposite of arrow 502 in FIG. 1. The depression 802 then holds the pusher 700 so that merchandise may be re-stocked without having to manually hold the pusher out of the way while placing the merchandise on the track surface. To remove the pusher 700 from the depression 802, the pusher may be pushed toward the back of the track 800, the pusher will then return to an upright position and move along the track 800 in its usual way.

Figure 12:
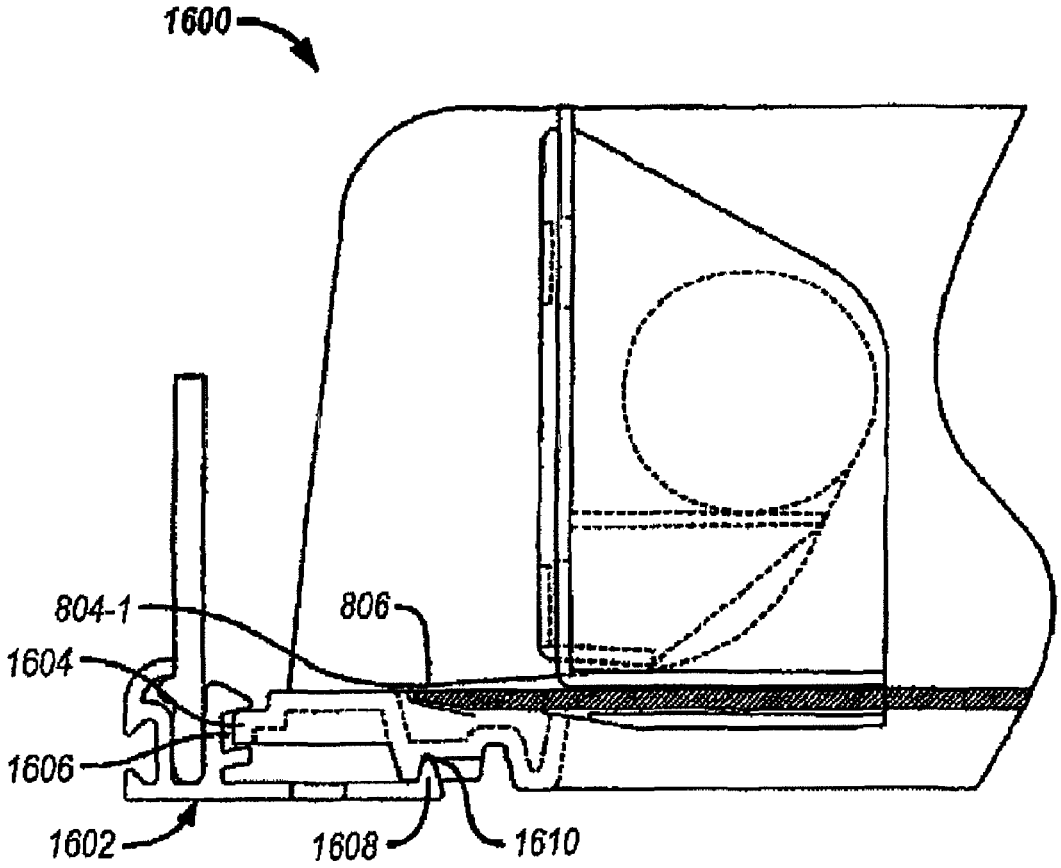
FIG. 12 is a partial side view of a cross-section of a bent end of a pusher's coiled spring engaging the front edge of a pusher track in accordance with an illustrative embodiment of the invention.

Front edges 804-1 and 804-2 of the respective surfaces that the pusher travels along may automatically engage a bent portion of the pusher's coiled spring when the pusher is inserted onto the front of the track 800. FIG. 12 is a partial side view of a cross-section of a bent end of a spring 806 engaging the front edge 804-1 of the track 800.

FIG. 12 also shows a complimentary tongue and groove engagement between a component 1600, which includes a pusher track, and a front rail 1602 in accordance with an illustrative embodiment of the invention. A tongue 1604 of the component 1600 engages a groove 1606 of the front rail 1602, and a tongue 1608 of the front rail 1602 engages a groove 1610 in the component.

Figure 13:
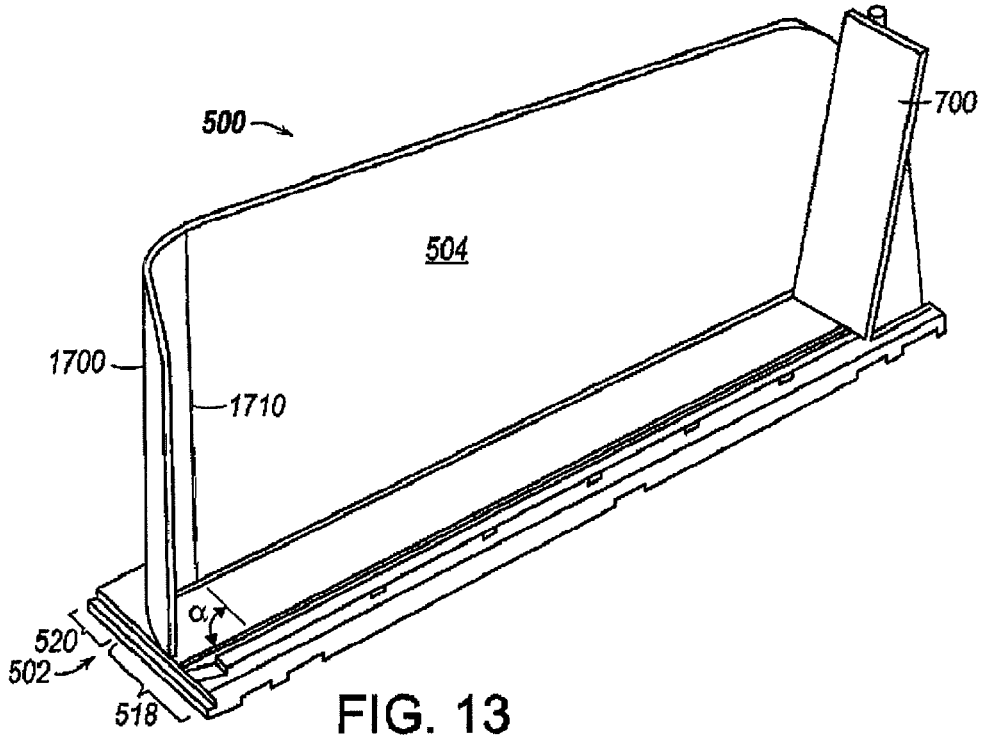
FIG. 13 is a front perspective view of an alternative embodiment of a T assembly.
Figure 14:
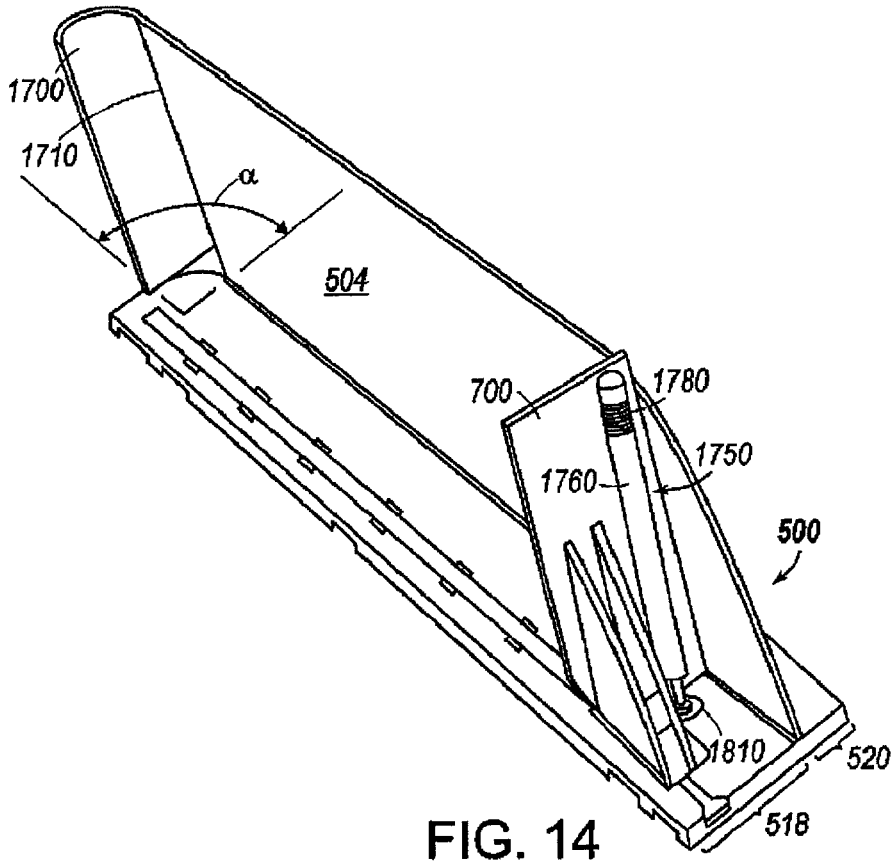
FIG. 14 is a rear perspective view of the T assembly of FIG. 13.
Figure 15:
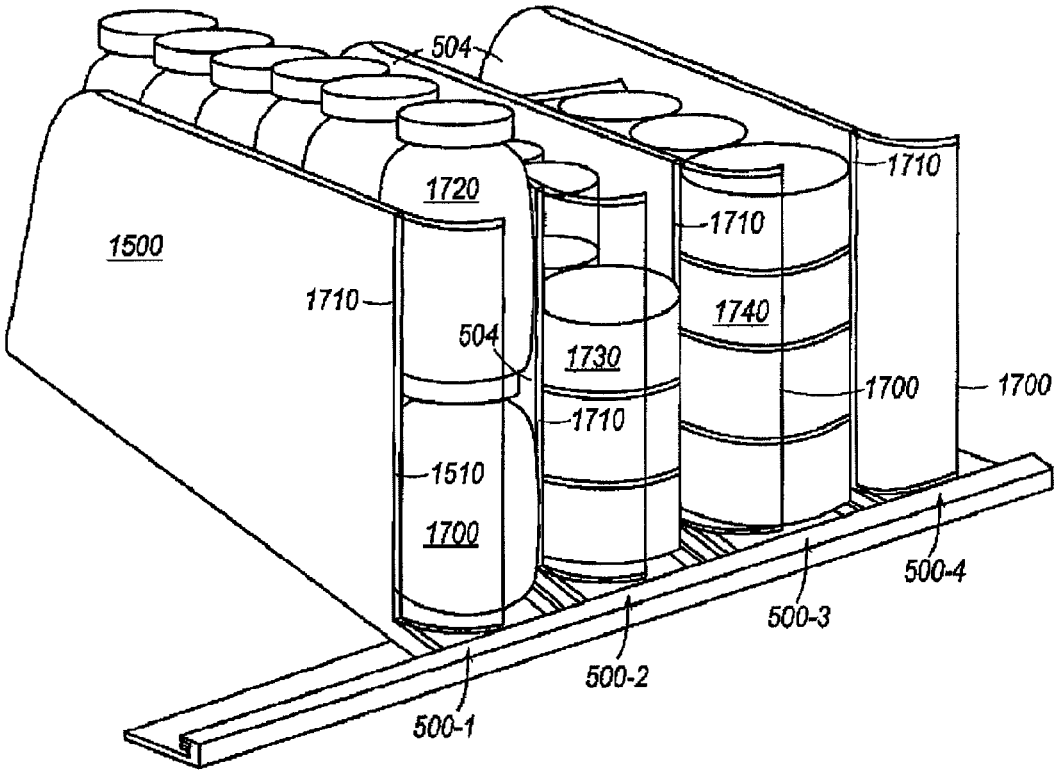
FIG. 15 is a front perspective view of products of different sizes on multiple T assemblies of FIG. 13.

Another embodiment of a T assembly 500 is seen in FIGS. 13-15, in which a retaining member such as a retaining wall 1700 is provided at a front edge 1710 of divider 504. Retaining wall 1700 curves inwardly along first portion 518 of T assembly 500. In the illustrated embodiment, retaining wall 1700 is formed of a transparent material, such as a clear plastic, providing visibility through retaining wall 1700 to the product retained within T assembly 500. In other embodiments, retaining wall 1700 may be formed on an opaque or translucent material.

In certain embodiments, as illustrated in FIGS. 13-14, retaining wall 1700 extends along an arc $\alpha$. It is to be appreciated that arc can have any desired value, preferably between about 0° and about 180°, more preferably between about 60° and about 120°, and most preferably about 90°.

As can be seen in FIG. 15, in which T assemblies 500-1 through 500-4 and left end component 1500 are seen, retaining walls 1700 are particularly useful to help retain cylindrical or round products such as glass jars 1720 (e.g., baby food jars) and cans 1730, 1740 on the shelf. Retaining walls help reduce the chance of the products on the shelf from riding past one another. It is to be appreciated that retaining walls 1700 could have the same height as dividers 504, or they could be higher or shorter than dividers 504.

As discussed above, retaining walls 1700 curve inwardly from front edge 1710 of dividers 504. A retaining wall 1700 also curves inwardly from a front edge 1510 of left end component 1500.

By configuring retaining walls 1700 such that they extend only along a portion of first portion 518 to T assemblies 500-1 through 500-4, e.g., along an arc of about 90°, they provide space for a customer's fingers to reach in and retrieve a product whose top is below that of the top of retaining wall 1700 and divider 504. Thus, as seen here, in the middle row containing products, the topmost product 1730 can easily be retrieved, even though it is lower than the top of retaining wall 1700 and divider 504.

It is to be appreciated that retaining wall 1700 can be a separate element secured to divider 504 and the base of T assembly 500 by adhesive or other suitable means, or that retaining wall 1700 can be of unitary, that is, one-piece, construction with divider 504, the base, or both. In certain embodiments, retaining wall 1700 could have one or more apertures formed therein. In such an embodiment, retaining wall 1700 may be formed of an opaque material and the product would still be visible through the apertures.

In certain embodiments, rather than extending along a smooth curve, retaining wall 1700 may be formed of multiple linear segments connected to one another at opposed ends thereof It is to be appreciated that in certain embodiments, rather than a substantial solid member such as retaining wall 1700, the retaining member could have a smaller or less substantial profile. For example, the retaining member could be a bar extending from divider 504 and curving along first portion 518. In other embodiments, the retaining member could be a plurality of bars extending from divider 504 along first portion 518. The free end(s) of the bar(s) opposite divider 504 could be connected to one another by another member in certain embodiments. In other embodiments, the retaining member could be formed of a plurality of members, such as rods or pins, extending upwardly from T assembly 500 and positioned substantially along an arc curving inwardly from divider 504 along first portion 518. Such members could be received in apertures or recesses formed in T assembly 500, or they could be secured directly to T assembly 500 by adhesive or other suitable fastening means.

In other embodiments, the retaining member could be formed of a mesh or screen material rather than a solid wall. Such a mesh or screen material may be positioned within a frame member that is attached to divider 504. In other embodiments, such a mesh or screen member could be secured directly to divider 504. The mesh and/or screen material of such a retaining member could extend as high as divider 504, or it could have a height that is greater than or less than that of divider 504.

Figure 16:
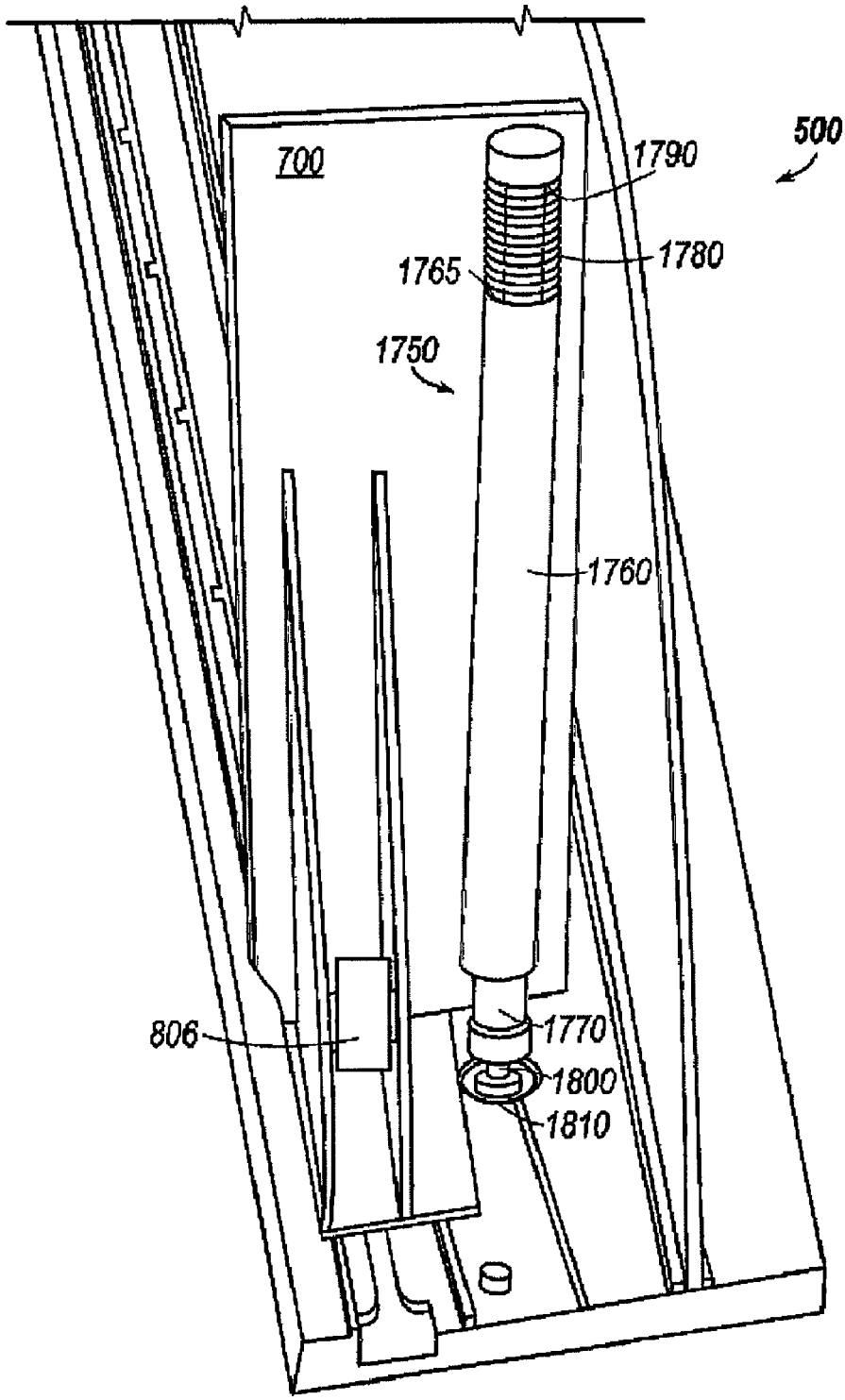
FIG. 16 is a rear perspective view of an alternative embodiment of a pusher, shown in a retracted position on a T assembly.
Figure 17:
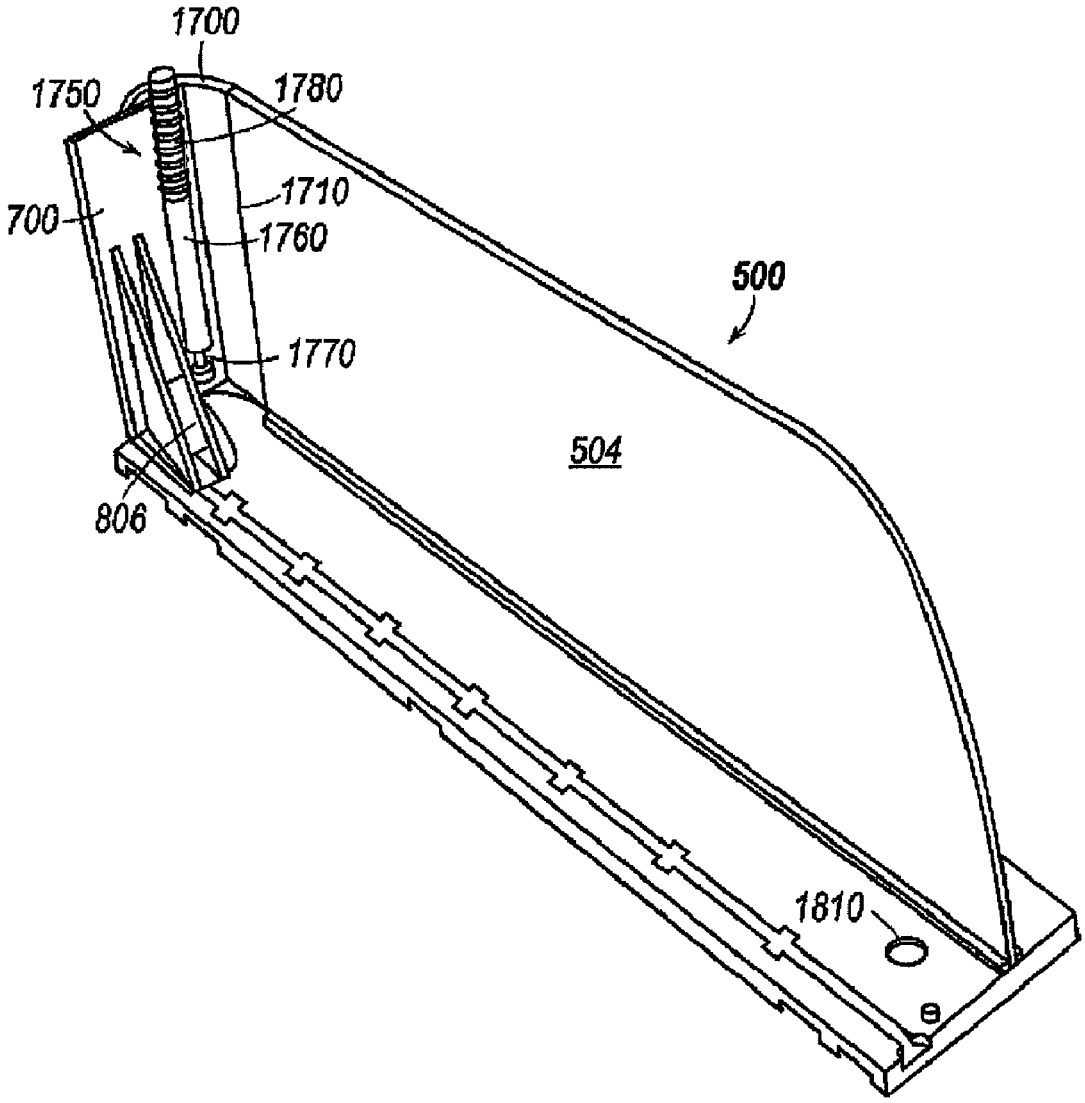
FIG. 17 is a rear perspective view of the pusher of FIG. 16, shown in its forwardmost position.

In certain embodiments, pusher 700 includes a pusher retaining assembly 1750, as seen in FIGS. 16-17, which serves to retain pusher 700 in a retracted position at the rear of T assembly 500 to facilitate loading of product. Pusher retaining assembly 1750 includes a housing 1760, which is a cylindrical member in the illustrated embodiment having an aperture 1765 extending therethrough. Housing is positioned on a rear surface of pusher 700. In certain embodiments, housing 1760 is a separate element secured to pusher 700 by adhesive or other suitable means. In other embodiments, housing 1760 may be of unitary, that is, one-piece, construction with pusher 700.

A pin 1770 extends through aperture 1765 in housing 1760, and is biased upwardly by a biasing member 1780. In the illustrated embodiment, biasing member 1780 is a spring 1780 surrounding an upper end of pin 1770. Spring 1780 is positioned between an upper edge of housing 1760 and a shoulder 1790 formed proximate a top of pin 1770. An annular groove 1800 is formed near the bottom of pin 1770. An aperture 1810 is formed in the rear of the base of T assembly 500.

To maintain pusher 700 in its retracted position using pusher retaining assembly 1750, pusher 700 is pushed rearwardly along T assembly 500 until pusher retaining assembly 1750 is positioned above aperture 1810. The top of pin 1770 is then depressed against the biasing force of spring 1780, causing the lower end of pin 1770 to enter aperture 1810 such that annular groove 1800 engages the periphery of aperture 1810. Pusher 700 is then in the retained position while T assembly is filled with product. Once T assembly has been filled to a desired level, pusher 700 is pushed slightly rearwardly, allowing pin 1770 to move upwardly from the force of spring 1780, and pusher 700 then moves forward due to the force of spring 806.

It is to be appreciated that a suitable pusher retaining assembly can have any of numerous configurations. For example, in certain embodiments, a pusher retaining assembly could be formed of a pair of magnets, with one magnet being secured to pusher 700 and a second magnet secured to T assembly 500, allowing pusher 700 to be temporarily retained in its retracted position. In other embodiments, the pusher retaining assembly could include any type of fastener such as a snap or a hook and loop fastener. In other embodiments, a projection could be formed on one of pusher 700 and T assembly 500, which could be temporarily received in a mating recess or aperture formed in the other of pusher 700 and T assembly 500. Such a projection and mating recess or aperture could engage one another in a simple slide-in manner or in snap-fit fashion.

In another embodiment, a projection could be formed on one of pusher 700 and T assembly 500, and a hook member could be pivotally secured to the other of pusher 700 and T assembly 500. When T assembly 500 is pushed to its retracted position, the hook member could be pivoted such that it engages and hooks on the projection, thereby retaining pusher 700 in its retracted position.

Other potential fasteners for use in a pusher retaining assembly include clips, clamps, clasps, cables, pins, latches, clevis pins, tape and adhesive.

Figure 18:
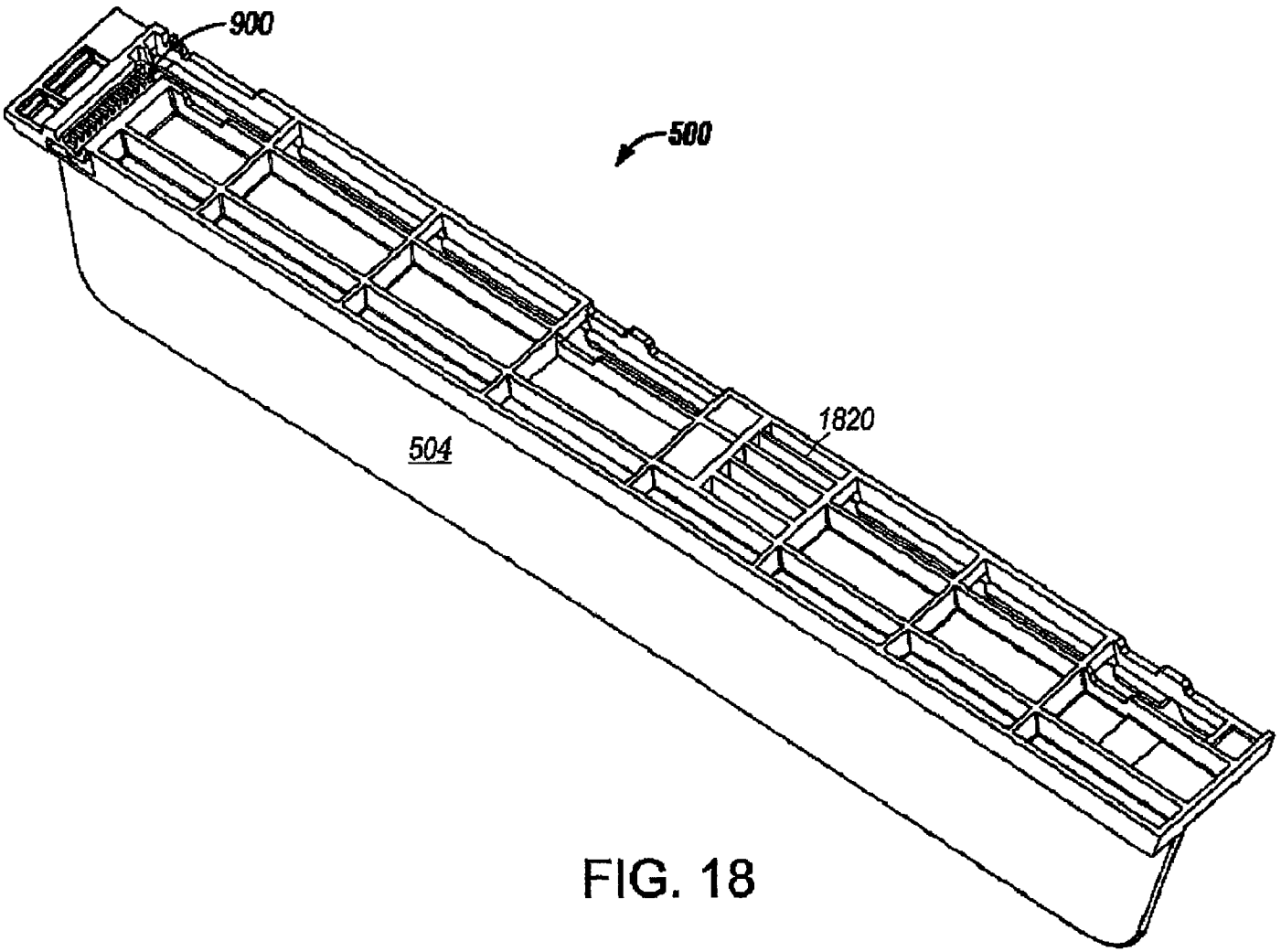
FIG. 18 is a bottom perspective view of another alternative embodiment of a T assembly.
Figure 19:
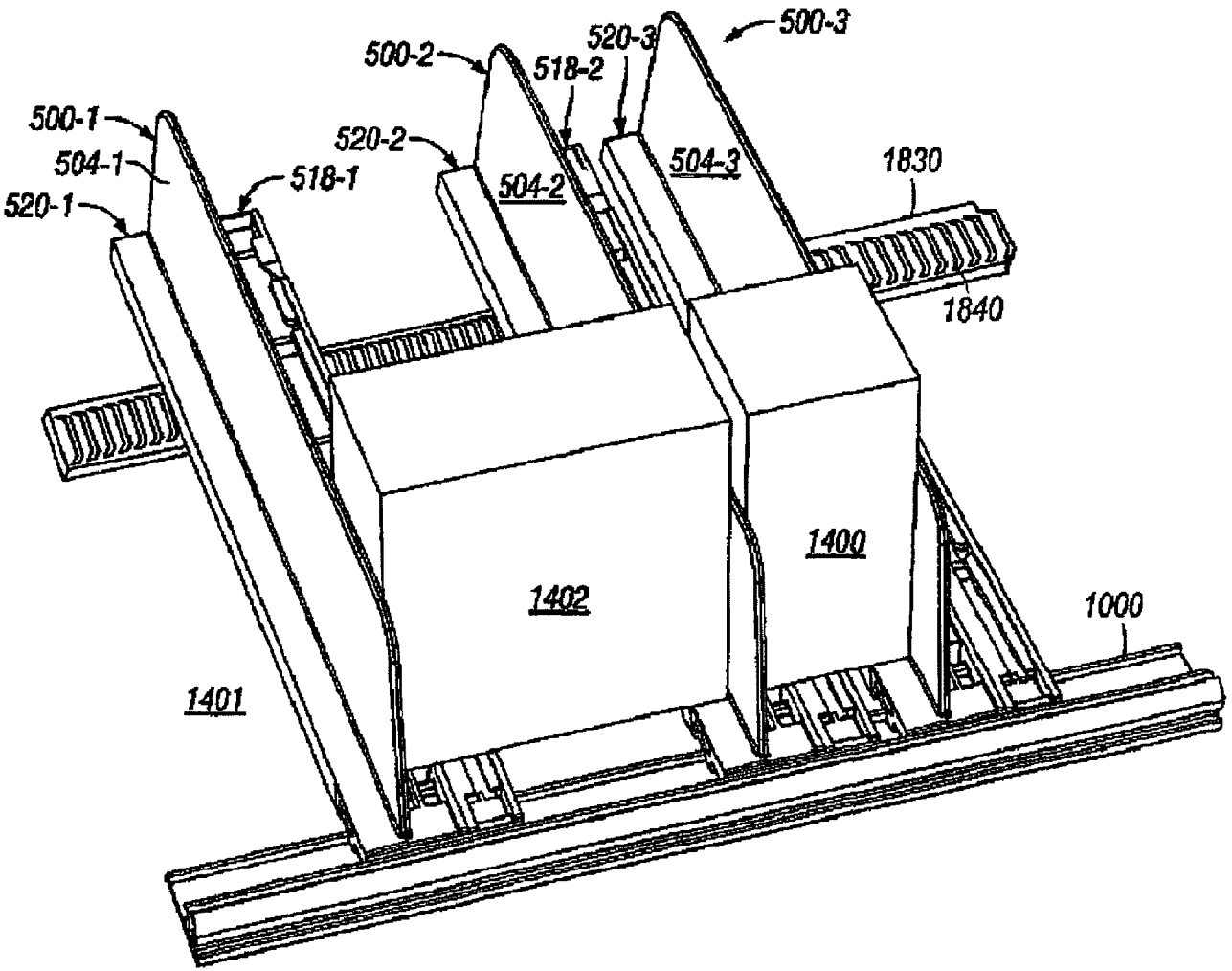
FIG. 19 is a front perspective view of a plurality of the T assemblies of FIG. 18, shown installed on a first front track and a second rearward track.
Figure 20:
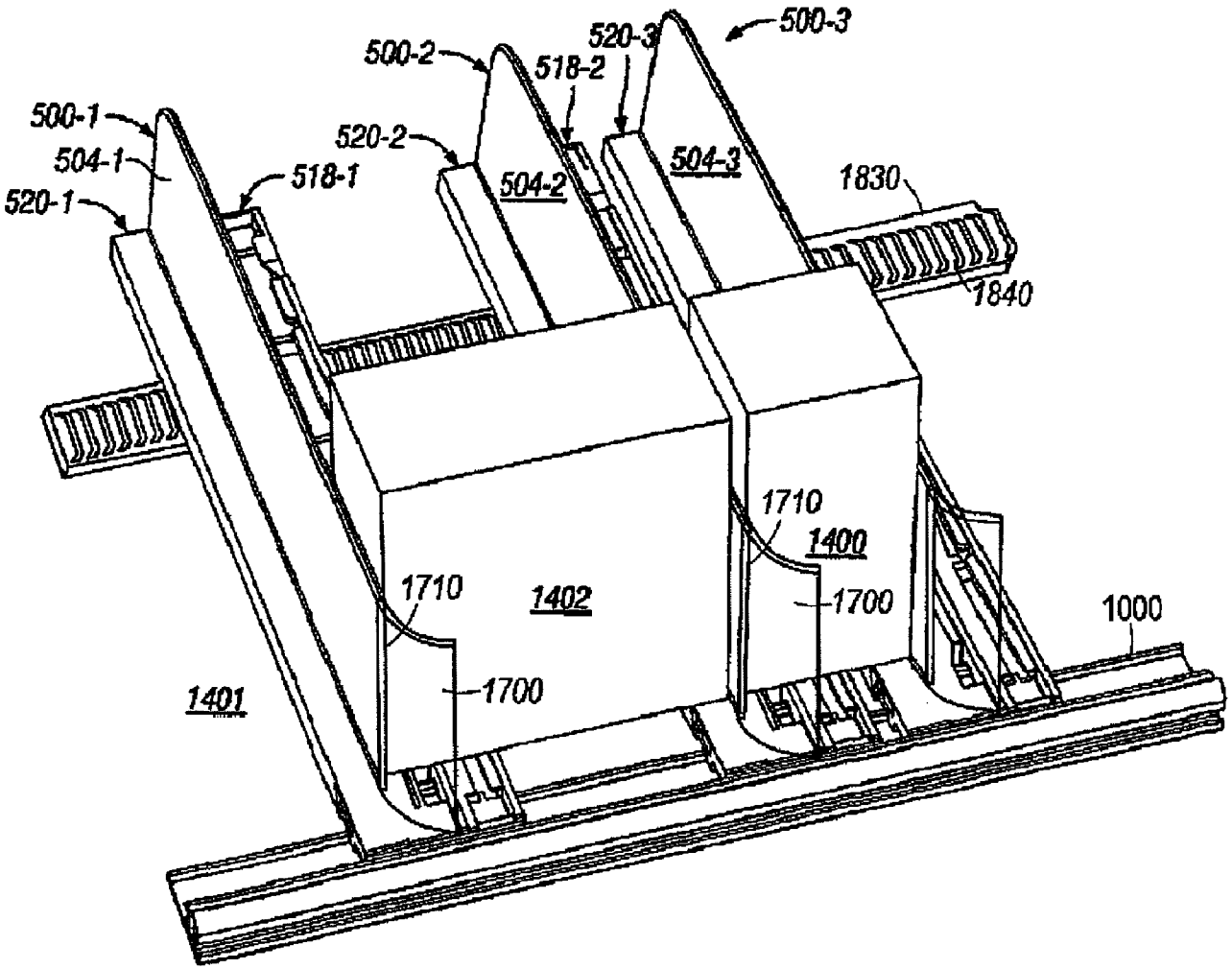
FIG. 20 is a front perspective view of a plurality of the T assemblies of FIG. 18, shown installed on a first front track and a second rearward track and with the curved front retaining walls of the T assembly of FIG. 13.
Figure 21:
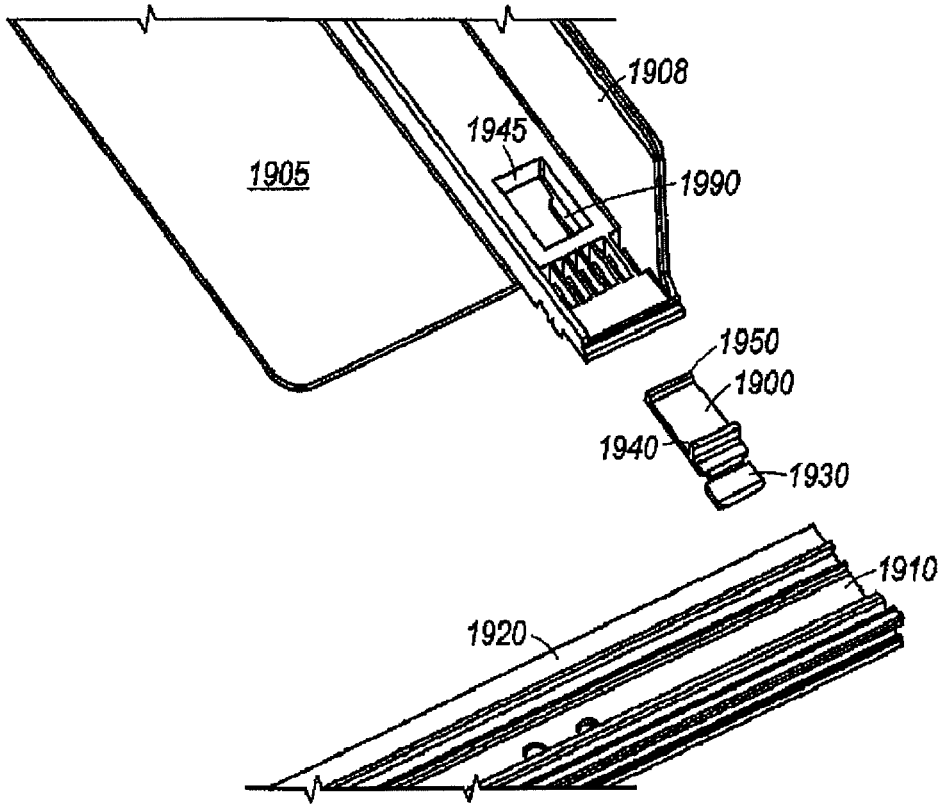
FIG. 21 is a perspective view in exploded form showing a locking clip to be used with a front rail and base portion.
Figure 22:
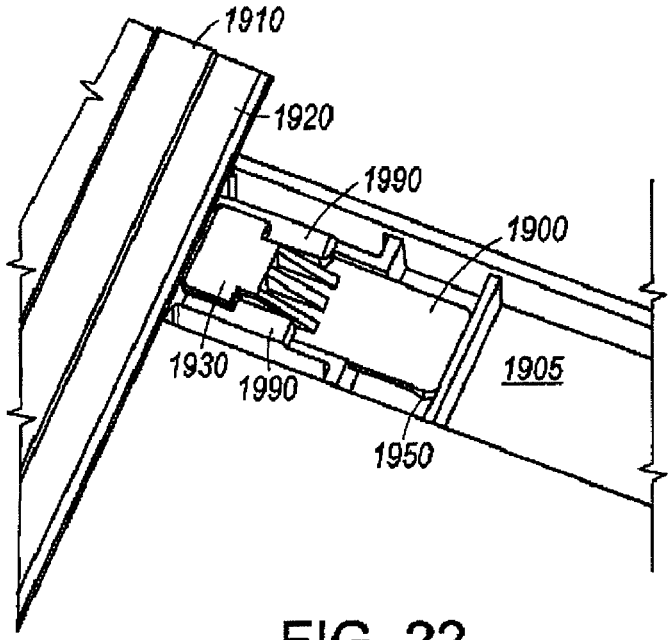
FIG. 22 is a bottom perspective view showing a locking clip prior to engagement with a front rail.

In another embodiment, illustrated in FIGS. 18-20, a plurality of ribs 1820 are formed on an underside of the base of T assembly 500. Ribs 1820 extend substantially parallel to one another and are located toward the rear of the base. In certain embodiments, ribs 1820 are positioned rearwardly of the front of T assembly 500, and may be positioned between about ⅔ and about ¾ of the way back from the front of the base of T assembly 500. A secondary rail 1830 is positioned rearwardly of front rail 1000 beneath the base of T assembly 500. In certain embodiments, secondary rail 1830 is positioned between approximately ⅔ and about ¾ of the way along the base of T assembly 500. A plurality of projections, which in this embodiment take the form of fins 1840 are provided on the top surface of secondary rail 1830. When the base of each T assembly 500 is positioned on secondary rail 1830, ribs 1820 mesh with fins 1840 in engaging fashion, reducing the tendency of the bases of T assembly 500 to splay proximate their rear ends when product is seated in T assemblies 500. T assembly 500 can be positioned at any desired location along secondary rail 1830 due to the plurality of fins 1840.

Secondary rail 1830 is shown in FIG. 19 with T assemblies 500 including only dividers 504, while FIG. 20 illustrates secondary rail 1830 with T assemblies including front retaining walls 1700 at the front end of dividers 500. As can be seen in FIGS. 19-20, the provision of secondary rail 1830 with its fins 1840 and the corresponding ribs 1820 on T assemblies 500 cooperate to prevent the splaying of T assemblies 500 proximate their rear ends when product is seated on the shelf between the dividers 504.

As illustrated here, fins 1840 are dispersed evenly along secondary rail 1820 at regular intervals in a substantially continuous fashion. It is to be appreciated that in other embodiments, fins 1840 may be positioned at irregular intervals along secondary rail 1820. In other embodiments, fins 1840 may be positioned in a discontinuous manner along secondary rail 1820, with multiple sets of fins positioned at spaced apart intervals along secondary rail 1820. In such embodiments, the gaps between the sets of fins may be regularly spaced and of mating sizes, while in other embodiments, such gaps may vary in size such that the sets of fins are spaced apart from one another at irregular intervals.

In other embodiments, T assembly 500 and secondary rail 1820 may have different configurations, enabling them to engage one another and prevent splaying of T assemblies 500. For example, T assembly 500 may have one or more grooves or recesses that engage corresponding projection(s) on secondary rail 1820. Such grooves or recesses can be engaged with the projections in a simple slip-in manner, or they may be engaged in a more secured snap-fit fashion. The grooves or recesses can have any desired shape, and can be provided at any desired location on T assembly 500. Such grooves or recesses can be positioned on the underside of T assembly 500, as seen above with ribs 1820, or can be provided on other surfaces of T assembly 500, such as on its sides or top. When a plurality of grooves or recesses is formed on T assembly 500, they may be evenly spaced along T assembly 500, as seen above with respect to ribs 1820. In other embodiments, the grooves or recesses may be spaced apart by irregular intervals or positioned in a non-regular or random pattern on T assembly 500.

In other embodiments, T assembly 500 may include one or more projections that extend outwardly from one of its surfaces, such as the underside or sides of T assembly 500, and which are engaged in corresponding grooves or recesses formed in secondary rail 1820. Such projections can be engaged with the grooves or recesses in a simple slip-in manner, or they may be engaged in a more secured snap-fit fashion. These projections can take on any desired shape such as pins that would be received in mating holes formed in secondary rail 1830. Such projections can be positioned at any desired location along T assembly 500. Thus, these projections may also be positioned on the underside, sides or top of T assembly 500, for example. As noted above with respect to the grooves or recesses, these projections may be evenly spaced along T assembly 500, spaced apart by irregular intervals, or positioned in a non-regular or random pattern on T assembly 500.

In certain embodiments, secondary rail 1830 may have projections with shapes other than fins extending outwardly from its surface, such as pins that would be received in mating holes in T assembly 500. Such projections may extend from the top surface, as illustrated with respect to fins 1840, or from the front or rear sides of secondary rail 1830. These projections may be evenly spaced along T assembly 500, spaced apart by irregular intervals, or positioned in a non-regular or random pattern on T assembly 500.

As discussed above with respect to T assembly 500, secondary rail 1820 may have one or more grooves or recesses that engage corresponding projection(s) formed on T assembly 500. Such grooves or recesses can be positioned on the top of secondary rail 1820, as seen above with respect to fins 1840, or can be provided on other surfaces of secondary rail 1820, such as its sides or its top. When a plurality of grooves or recesses is formed in secondary rail 1820, they may be evenly spaced along secondary rail 1820, as seen above with respect to ribs 1820. In other embodiments, the grooves or recesses may be spaced apart by irregular intervals or positioned in a non-regular or random pattern on secondary rail 1820.

In other embodiments, T assemblies 500 and secondary rail 1830 may be engaged with one another by other means, such as by a fastener, for example. Suitable fasteners include magnets, hook-and-loop fasteners, snaps, clips, clamps, clasps, cables, latches, clevis pins, tape and adhesives. The fasteners can be positioned at any location on T assemblies 500 and secondary rail 1830.

Another embodiment is shown in FIGS. 21-26, in which a locking clip 1900 is used in conjunction with a merchandise display system. In the illustrated embodiment, locking clip 1900 is shown in use with a right-end component having a base portion 1905 and a divider component 1908, and a front rail 1910. Locking clip 1900 works to prevent base portion 1905 from being inadvertently lifted and disengaged from front rail 1910. It is to be appreciated that locking clip 1900 will work in the same manner with a T assembly 500, a left-end component 1500, a rack 800, or any other component that has a track that is engaged with a front rail.

Front rail 1910 includes a leg 1920 extending rearwardly along its rear edge. Locking clip 1900 includes an arm 1930 at a forward edge thereof that is positioned beneath leg 1920 when locking clip 1900 is in a locked condition, as described in greater detail below. A projection such as a rib 1940 extends upwardly from a central portion of locking clip 1900 through an aperture 1945 formed in a forward end of base portion 1905. A user can move locking clip 1900 between its locked and unlocked positions by grasping rib 1940 and moving it, and, therefore, locking clip 1900, forwardly and rearwardly within aperture 1945. A lip 1950 extends upwardly from a rear end of locking clip 1900.

A pair of locking rails 1960 extends along a lower surface of a forward end of base portion 1905. Each locking rail 1960 includes a first recess 1970 at a rear portion thereof. Each locking rail 1960 also includes a second recess 1980 positioned slightly forward of first recess 1970. It is to be appreciated that first and second recesses 1970, 1980 may, in certain embodiments, be formed directly in a lower surface of base portion 1905 without the need for separate locking rails.

A pair of flanges 1990 is positioned on a lower surface of base portion 1905 beneath and on opposite sides of aperture 1945. Locking clip 1900 is slidingly captured between flanges 1990 and the lower surface of base portion 1905 such that locking clip 1900 can move forwardly and backwardly with respect to base portion 1905.

Figure 23:
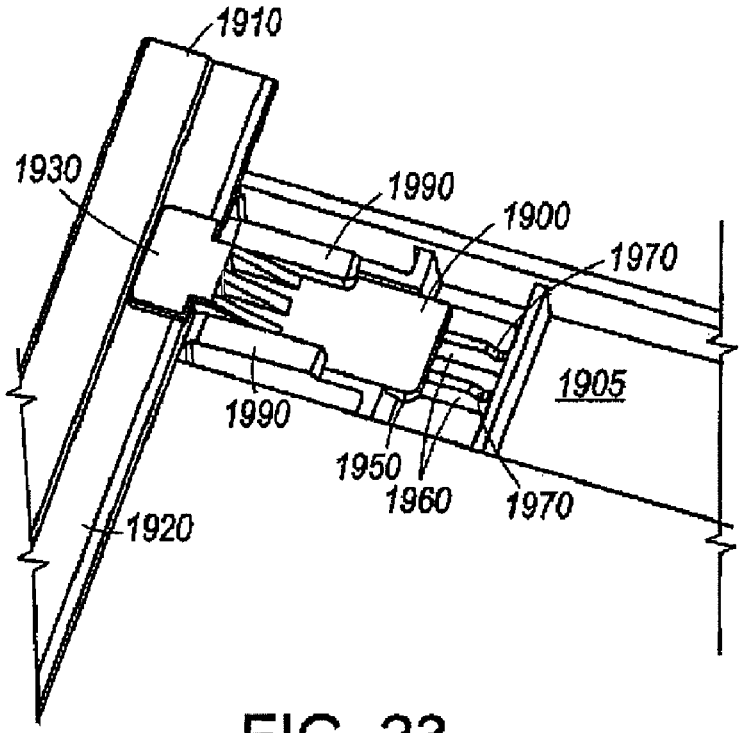
FIG. 23 is a bottom perspective view showing a locking clip engaged with a front rail.
Figure 25:
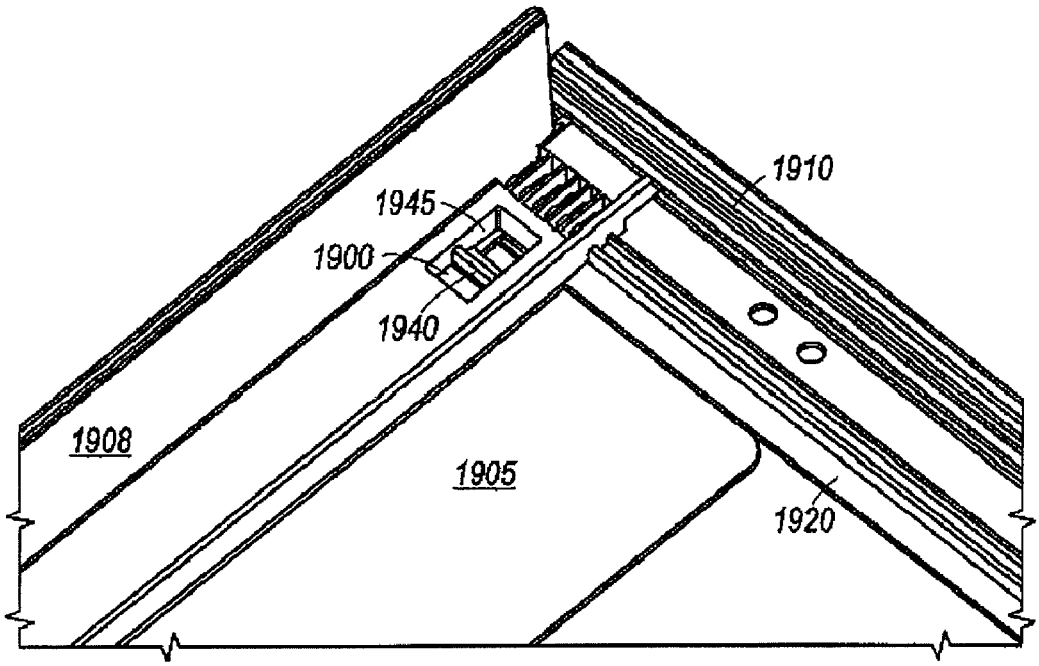
FIG. 25 is a bottom perspective view showing a locking clip in its unlocked position.
Figure 26:
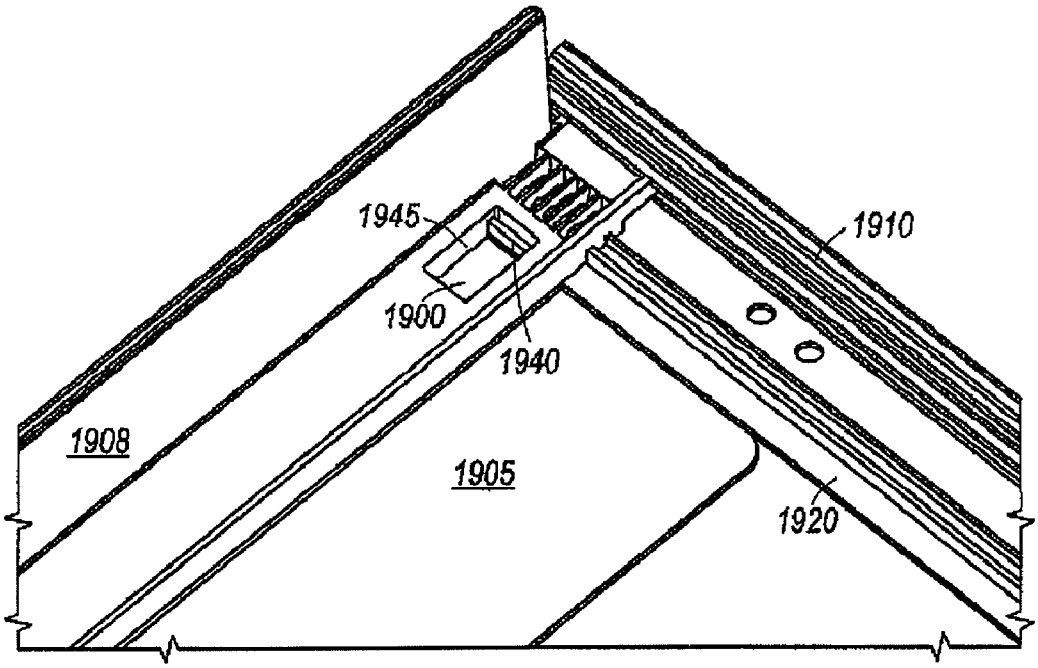
FIG. 26 is a bottom perspective view showing a locking clip in its locked position.

To operate locking clip 1900, the user grasps rib 1940, which is seen most clearly in FIG. 25 where locking clip 1900 is seen in its unlocked condition, and moves it forward to the locked position seen in FIG. 26. As locking clip 1900 is moved forward, arm 1930 moves from its unlocked position, seen in FIG. 22, to its locked position beneath leg 1920 of front rail 1910, as seen in FIG. 23 where the lower side of locking clip 1900, base portion 1905 and front rail 1910 are seen. With arm 1930 positioned beneath leg 1920, base portion 1905 and front rail 1920 are engaged, thereby preventing inadvertent movement of base portion 1905 with respect to front rail 1910.

Figure 24:
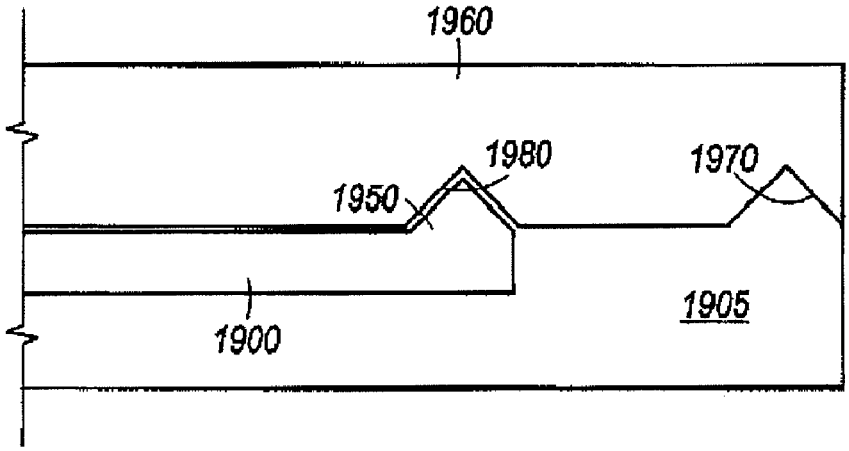
FIG. 24 is an elevation view showing engagement of a rib on a locking clip engaged with a locking rail.

The engagement of lip 1950 of locking clip 1900 with first and second recesses 1970, 1980 of locking rails 1960 is best seen in FIGS. 23-24. When locking clip 1900 is in its unlocked position, lip 1950 is received in first recesses 1970, thereby registering locking clip 1900 with respect to base portion 1905 in its unlocked position. Similarly, when locking clip 1900 is in its locked position, lip 1950 is received in second recesses 1980, thereby registering locking clip 1900 with respect to base portion 1905 in its locked position.

While the invention has been described with respect to specific examples including presently preferred modes of carrying out the invention, those skilled in the art will appreciate that there are numerous variations and permutations of the above described systems and techniques that fall within the spirit and scope of the invention.

What is claimed is:

1. A merchandise display system comprising:

a base-and-divider assembly including a base portion adapted for operative coupling to a front rail, a divider portion for dividing displayed merchandise into rows, and a pusher track, the divider portion protruding from the base portion such that the divider portion separates the base portion into a first portion and a second portion;

a spring-urged pusher mounted to the pusher track for pushing merchandise toward the front of a shelf, a retaining wall curving inwardly from a front edge of the divider portion along at least a portion of the first portion, and a front rail having a leg extending outwardly from a rear surface thereof, the arm of the locking clip engaging the leg when the locking clip is in a locked position, wherein the retaining wall is at least a same height as the divider portion, and wherein the base portion includes an aperture extending therethrough, and a pair of flanges on a lower surface thereof, and further comprising:

a locking clip slidingly captured between the flanges and the lower surface of the base portion and having:

an arm extending outwardly from a front edge thereof and configured to engage with the front rail; and a projection on a top surface thereof extending through the aperture in the base portion.

2. The merchandise display system of claim 1, wherein the retaining wall is formed of a transparent material.

3. The merchandise display system of claim 1, wherein the retaining wall extends along an arc of about 90°.

4. The merchandise display system of claim 1, wherein the retaining wall is secured to the divider portion and the base portion with an adhesive.

5. The merchandise display system of claim 1, wherein the retaining wall is of unitary construction with the divider portion.

6. The merchandise display system of claim 1, further comprising:

a pusher retaining assembly comprising:

a housing secured to the pusher and having an aperture extending therethrough;

a pin extending through the aperture in the housing; and a biasing member configured to bias the pin upwardly away from the base portion; and an aperture formed in the base portion, a lower end of the pin being receivable in the aperture.

7. The merchandise display system of claim 6, further comprising a shoulder formed at an upper end of the pin, the biasing member acting against the shoulder to bias the pin upwardly.

8. The merchandise display system of claim 6, wherein the biasing member comprises a spring.

9. The merchandise display system of claim 6, further comprising an annular groove formed in the lower end of the pin, the groove engaging the aperture to retain the pusher in a retracted position.

10. The merchandise display system of claim 6, wherein the housing is positioned on a rear surface of the pusher.

11. The merchandise display system of claim 6, wherein the housing is a cylindrical member.

12. The merchandise display system of claim 1, further comprising a plurality of ribs on an underside of the base portion rearward of a front of the base portion.

13. The merchandise display system of claim 12, further comprising a secondary rail having a plurality of projections on a top surface thereof, the projections configured to mesh with the ribs of the base portion.

14. The merchandise display system of claim 13, wherein the projections comprise fins.

15. The merchandise display system of claim 1, further comprising:

a plurality of additional base-and-divider assemblies, each assembly having a base portion, a divider portion, a pusher track, and a retaining wall, each base portion being mounted to the front rail such that the divider portions are spaced from one another;

a plurality of additional spring-urged pushers, each pusher mounted to one of the pusher tracks for pushing merchandise toward the front of a shelf, and a plurality of products positioned between adjacent dividing portions.

16. The merchandise display system of claim 15, further comprising:

a plurality of ribs on an underside of the base portion of each base-and-divider assembly rearward of the front of the base portion; and a secondary rail having a plurality of projections on a top surface thereof, the secondary rail positioned rearwardly of the front rail and beneath the base portions, the ribs engaging the projections.

17. The merchandise display system of claim 16, wherein the projections are fins.

18. The merchandise display of claim 1, further comprising:

at least one first recess and at least one second recess formed on a lower surface of the base portion; and a lip formed on an upper surface of the locking clip, the lip engaging at least one first recess when the locking clip is in an unlocked position and engaging at least one second recess when the locking clip is in a locked position.

19. The merchandise display system of claim 18, wherein the base portion includes a pair of locking rails on its lower surface, the first and second recesses being formed on the locking rails.

20. A merchandise display system comprising:

a base-and-divider assembly including a base portion adapted for operative coupling to a front rail, a divider portion for dividing displayed merchandise into rows, and a pusher track, the divider portion protruding from the base portion such that the divider portion separates the base portion into a first portion and a second portion;

a spring-urged pusher mounted to the pusher track for pushing merchandise toward the front of a shelf, and a transparent retaining wall curving inwardly from a front edge of the divider portion along an arc of about 90°, the transparent retaining wall extending along only a portion of the first portion and defining an opening in the remaining portion of the first portion, wherein the opening is horizontally adjacent the retaining wall.

21. The merchandise display system of claim 20, further comprising:

a pusher retaining assembly comprising:

a housing secured to the pusher and having an aperture extending therethrough;

a pin extending through the aperture in the housing; and a biasing member configured to bias the pin upwardly away from the base portion; and an aperture formed in the base portion, a lower end of the pin being receivable in the aperture.

22. A merchandise display system comprising:

a base-and-divider assembly including a base portion adapted for operative coupling to a front rail, a divider portion for dividing displayed merchandise into rows, and a pusher track, the divider portion protruding from the base portion such that the divider portion separates the base portion into a first portion and a second portion;

a spring-urged pusher mounted to the pusher track for pushing merchandise toward the front of a shelf, a transparent retaining wall curving inwardly from a front edge of the divider portion along an arc of about 90° and extending along only a portion of the first portion, a pusher retaining assembly comprising:

a housing secured to the pusher and having an aperture extending therethrough;

a pin extending through the aperture in the housing; and a biasing member configured to bias the pin upwardly away from the base portion;

an aperture formed in the base portion, a lower end of the pin being receivable in the aperture; and a shoulder formed at an upper end of the pin, the biasing member acting against the shoulder to bias the pin upwardly.

23. The merchandise display system of claim 21, wherein the biasing member comprises a spring.

24. The merchandise display system of claim 21, further comprising an annular groove formed in the lower end of the pin, the groove engaging the aperture to retain the pusher in a retracted position.

25. The merchandise display system of claim 21, wherein the housing is positioned on a rear surface of the pusher.

26. The merchandise display system of claim 20, wherein product is removed from the display system through the opening.

* * * * *